US006680165B1

(12) United States Patent
Poslusny et al.

(10) Patent No.: US 6,680,165 B1
(45) Date of Patent: Jan. 20, 2004

(54) CYAN COUPLER DISPERSION WITH INCREASED ACTIVITY

(75) Inventors: Jerrold N. Poslusny, Rochester, NY (US); Paul B. Merkel, Victor, NY (US); David A. Steele, Webster, NY (US); Drake M. Michno, Webster, NY (US); David S. Ross, Rochester, NY (US); Richard K. Rothrock, Naples, NY (US); Paul L. Zengerle, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/279,892

(22) Filed: Oct. 24, 2002

(51) Int. Cl.[7] ..... G03C 1/08; G03C 7/26; G03C 7/32

(52) U.S. Cl. ..... 430/546; 430/552; 430/553; 430/384; 430/385

(58) Field of Search ..... 430/546, 552, 430/553, 384, 385

(56) References Cited

U.S. PATENT DOCUMENTS

| | | | | |
|---|---|---|---|---|
| 4,333,999 | A | | 6/1982 | Lau |
| 4,551,422 | A | | 11/1985 | Kimura et al. |
| 4,613,564 | A | | 9/1986 | Takada et al. |
| 4,774,166 | A | | 9/1988 | Sasaki et al. |
| 4,863,840 | A | | 9/1989 | Komorita et al. |
| 4,882,267 | A | | 11/1989 | Hirabayashi et al. |
| 4,923,791 | A | | 5/1990 | Merkel et al. |
| 4,973,535 | A | | 11/1990 | Merkel et al. |
| 5,019,493 | A | | 5/1991 | Sato et al. |
| 5,192,651 | A | | 3/1993 | Tsukahara et al. |
| 5,210,011 | A | | 5/1993 | Tsukahara et al. |
| 5,382,500 | A | * | 1/1995 | Sugita et al. ..... 430/505 |
| 5,585,230 | A | | 12/1996 | Zengerle et al. |
| 5,726,002 | A | | 3/1998 | Lau et al. |
| 5,726,003 | A | | 3/1998 | Zengerle et al. |
| 5,834,175 | A | | 11/1998 | Zengerle et al. |
| 6,004,738 | A | | 12/1999 | Lau et al. |
| 6,200,741 | B1 | | 3/2001 | Stanley et al. |
| 6,221,571 | B1 | | 4/2001 | Zengerle et al. |
| 6,242,169 | B1 | | 6/2001 | Hagemann et al. |
| 2002/0018971 | A1 | | 2/2002 | Hagemann et al. |
| 2002/0028412 | A1 | * | 3/2002 | Yang et al. ..... 430/957 |

FOREIGN PATENT DOCUMENTS

| | | |
|---|---|---|
| DE | 39 36 300 | 5/1991 |
| JP | 59-24848 | 2/1984 |
| JP | 61-36746 | 2/1986 |
| JP | 2-43540 | 2/1990 |

* cited by examiner

*Primary Examiner*—Geraldine Letscher
(74) *Attorney, Agent, or Firm*—Andrew J. Anderson

(57) ABSTRACT

The invention provides a color negative photographic element comprising a light sensitive silver halide emulsion imaging layer having associated therewith a cyan dye-forming coupler dispersion comprising a first 2-ureido-5-acylamino substituted phenolic cyan dye-forming coupler [P], a second phenolic cyan dye-forming coupler [AP] where the 2-substituent is other than an ureido group, a substantially non-color-developable phenolic activator compound [ACT], and a non-phenolic organic coupler solvent having a boiling point of at least 150C; wherein compounds represented by [P], [AP], and [ACT] are present in the coupler dispersion in relative weight fractions of from 0.30 to 0.65 for [P], from 0.15 to 0.35 for [AP], and from 0.15 to 0.35 for [ACT], provided the sum of the relative weight fractions for [P]+[AP]+[ACT]=1, and the weight ratio of the non-phenolic coupler solvent in the coupler dispersion is from 0.30 to 2.0 relative to the sum of [P]+[AP]+[ACT]. Photographic elements incorporating the dispersion formulation of this invention provide good activity, a cyan dye of high density and acceptable absorption maximum for color negative films. In addition, partial substitution of less expensive cyan auxiliary phenolic coupler [AP] and activator [ACT] for cyan phenolic coupler [P] advantageously allows cost savings.

30 Claims, No Drawings

CYAN COUPLER DISPERSION WITH INCREASED ACTIVITY

FIELD OF THE INVENTION

This invention relates to silver halide photographic materials and methods of making such materials, and more specifically to photographic materials comprising dispersions of specific phenolic dye-forming photographic coupler combinations with limited amounts of phenolic activators.

BACKGROUND OF THE INVENTION

Color photographic recording materials generally contain silver halide emulsion layers sensitized to each of the blue, green and red regions of the visible spectrum, with each layer having associated therewith a color forming compound called a coupler. After exposure to light and being subjected to color development with a so-called color developer, the coupling reaction between the oxidation product of an aromatic primary amine and the coupler results in the formation of colored dyes. The blue, green and red sensitive layers yielding respectively, a yellow, magenta and cyan dye.

The coupling speed (hereinafter referred to as coupler activity) in the reaction is preferably desired to be as high as possible so as to obtain higher color density within the limited development time. Higher activity and higher color density are desired to minimize the amount of coupler that is necessary to be coated to obtain this higher color density.

Further, the quality of the resulting dye image is primarily based on the dye hues obtained from the respective color forming coupler compounds. A problem associated with such couplers is that the spectral absorption characteristics of dyes obtained therefrom may not be in the particular narrow wavelength range where absorption is most desired and therefore the coupler may be rejected for commercial use.

As cyan forming couplers capable of satisfying these characteristics for color negative films, phenols have popularly been used, including 2-acylamino-5-alkyl substituted, 2,5-diacylamino substituted, and 2-ureido-5-acylamino substituted phenols. However, the dyes of 2-acylamino substituted phenolic cyan couplers that have an alkyl group with 1 or more carbon atoms in the 5-position typically have an absorption maximum too hypsochromic to be useful for color negative films. The dyes of most 2,5 diacylamino based phenols are also too hypsochromic. While some phenolic couplers which incorporate 2-ureido-5-acylamino functionality are known to advantageously yield high activity, high color density, and suitable dye hue for color negative films, such advantageous couplers are often expensive to manufacture.

Attempts to alter phenolic coupler activities and the absorption characteristics of their respective dyes are usually focused on alterations of the structures of the coupler compounds. This approach, while enjoying some measure of success, is not only time consuming, but also involves the expense of highly focused research programs. Success with such programs is not predictable so that improvements in final coupler activity and final hue values have been elusive, even after concentrated research efforts.

Attempts to shift dye hues of phenolic couplers with addenda and coupler solvents are known (U.S. Pat. No. 5,019,493, U.S. Pat. No. 6,200,741 B1; U.S. Pat. No. 3,676,137; U.S. Pat. No. 4,973,535). The use of accelerators for increasing coupler activity has also been discussed (U.S. Pat. No. 4,774,166) but their use has been mostly associated with the elimination of benzyl alcohol from a color photographic paper processing, not color negative film. The use of non-color developable phenolic compounds as addenda or as organic solvent for 2-ureido-5-acylamino phenolic coupler dispersions has been suggested (U.S. Pat. No. 4,551,422). Such compounds, however, can shift the dye hue lambda max for such couplers to excessively long values for color negative film applications.

It would be desirable to have a cyan coupler dispersion formulation in a color negative photographic element that yields cyan dye of high activity and high density and of the appropriate dye absorption maximum while at the same time allowing for the reduction of expensive 2-ureido-5-acylamino color negative couplers.

SUMMARY OF THE INVENTION

The invention provides a color negative photographic element comprising a light sensitive silver halide emulsion imaging layer having associated therewith a cyan dye-forming coupler dispersion comprising a first phenolic cyan dye-forming coupler, a second phenolic cyan dye-forming coupler, a substantially non-color-developable phenolic activator compound, and a non-phenolic organic coupler solvent having a boiling point of at least 150C; wherein the first phenolic cyan dye-forming coupler is represented by the Formula [P]:

[P]

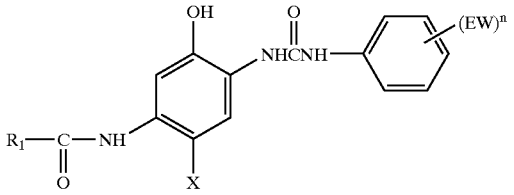

where $R_1$ represents a ballast group, n is from 0 to 3 and each EW represents independent electron withdrawing groups, and X represents a hydrogen atom or a coupling off group;

the second phenolic cyan dye-forming coupler is represented by [AP] and comprises at least one of Formula [AP-I] or Formula [AP-II]:

[AP-I]

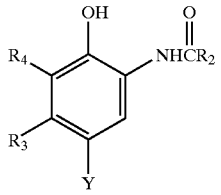

where $R_2$ represents a ballast group, $R_3$ represents an alkyl group, $R_4$ represents a hydrogen or halogen atom or an alkyl or an acylamino group, and Y represents a hydrogen atom or a coupling off group;

[AP-II]

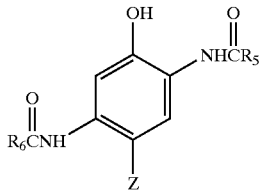

where where $R_5$ and $R_6$ each represents an aliphatic group, an aryl group or a heterocyclic group, and Z represents a hydrogen atom or a group capable of being released upon a coupling reaction with the oxidation product of a developing agent;

the substantially non-color-developable phenolic activator compound is represented by the Formula [ACT]:

[ACT]

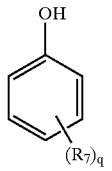

where q is from 1 to 3, and each $R_7$ independently represents an aliphatic group, a cycloalkyl group, an alkoxycarbonyl group, an aryloxycarbonyl group, an alkylcarbonyl group, an arylcarbonyl group, an acyloxy group, a sulfamoyl group, a sulfonamido group, a sulfonyl group, an aryl group, an alkoxy group, or a halogen atom; and wherein compounds represented by [P], [AP], and [ACT] are present in the coupler dispersion in relative weight fractions of from 0.30 to 0.65 for [P], from 0.15 to 0.35 for [AP], and from 0.15 to 0.35 for [ACT], provided the sum of the relative weight fractions for [P]+[AP]+[ACT]=1, and the weight ratio of the non-phenolic coupler solvent in the coupler dispersion is from 0.30 to 2.0 relative to the sum of [P]+[AP]+[ACT].

Photographic elements incorporating the dispersion formulation of this invention provide good activity, a cyan dye of high density and acceptable absorption maximum for color negative films. In addition, partial substitution of less expensive cyan auxiliary phenolic coupler [AP] and activator [ACT] for cyan phenolic coupler [P] advantageously allows cost savings.

DETAILED DESCRIPTION OF THE INVENTION

In accordance with the invention, 2-ureido-5-acylamino substituted phenolic cyan dye-forming couplers are used in combination with generally less expensive phenolic couplers where the 2-substituent is other than an ureido group, along with a substantially non-color-developable phenolic activator compound and a non-phenolic high boiling organic coupler solvent. 2-ureido-5-acylamino substituted phenolic cyan dye-forming couplers which may be employed in accordance with the invention may be represented by the Formula [P]:

[P]

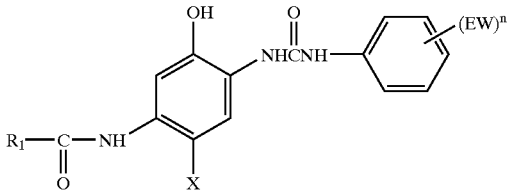

where $R_1$ represents a ballast group, n is from 0 to 3 and each EW represents independent electron withdrawing groups, and X represents a hydrogen atom or a coupling off group.

Electron withdrawing group substituents EW include groups having a Hammett's sigma para value greater than 0. Hammett's sigma values may be obtained from "Substituent constants for Correlation Analysis in Chemistry and Biology" by Hansch and Leo, available from Wiley and Sons, New York, N.Y. (1979). For example the aryl ring may be substituted with a cyano, chloro, fluoro, bromo, iodo, alkyl- or aryl-carbonyl, alkyl- or aryloxycarbonyl, acyloxy, carbonamido, alkyl- or aryl-carbonamido, alkyl- or aryloxycarbonylamino, alkyl- or aryl-sulfonyl, alkyl- or aryl-sulfonyloxy, alkyl- or aryl-oxysulfonyl, alkyl- or aryl-sulfoxide, alkyl- or aryl-sulfamoyl, alkyl- or arylsulfamoylamino, alkyl- or aryl-sulfonamido, aryl, alkyl, alkoxy, aryloxy, nitro, alkyl- or aryl- ureido or alkyl- or aryl-carbamoyl group, any of which may be further substituted. Preferred groups are halogen, cyano, alkoxycarbonyl, alkylsulfamoyl, alkylsulfonamido, alkylsulfonyl, carbamoyl, alkylcarbamoyl or alkylcarbonamindo.

$R_1$ represents a ballast group which controls the migration of the coupler when coated in a photographic layer. Representative ballast groups include substituted or unsubstituted alkyl, aryl, or heterocyclic groups containing 8 to 42 carbon atoms. Representative substituents on such groups include alkyl, aryl, alkoxy, aryloxy, alkylthio, hydroxy, halogen, alkoxycarbonyl, aryloxycarbonyl, carboxy, acyl, acyloxy, amino, anilino, carbonamido (also known as acylamino), carbamoyl, alkylsulfonyl, arylsulfonyl, sulfonamido, and sulfamoyl groups wherein the substituents typically contain 1 to 42 carbon atoms. Such substituents can also be further substituted. Alternatively, the molecule can be made immobile by attachment to a ballast in the form of a polymeric backbone. Preferred ballast groups include —CHR'—O-Aryl, where R' represents an alkyl group (preferably 1 to 12 carbon atoms) and Aryl represents an aryl substituent (e.g., phenyl) which may be substituted by, e.g., an alkyl, hydroxy, or alkylsulfonamido group, with branched alkyl group substituents such as t-butyl and t-pentyl being preferred.

Coupling-off groups are groups capable of being released upon a coupling reaction with the oxidation product of a developing agent and are well known in the art. Such groups can modify the reactivity of the coupler and determine the equivalent number of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, alkylthio (such as mercaptopropionic acid), arylthio, phosphonyloxy and arylazo. These coupling-off groups are described in the art, for example, in U.S. Pat. Nos. 2,455,169; 3,227,551; 3,432,521; 3, 476,563; 3,617,291; 3,880,661; 4,052,212 and 4,134,766; and in U.K. Patents and published Application Nos. 1,466,728; 1,531,927; 1,533,039; 2, 006,755A and 2,017,704A, the disclosures of which are incorporated herein by reference.

Representative couplers of Formula [P] include the following:

P1

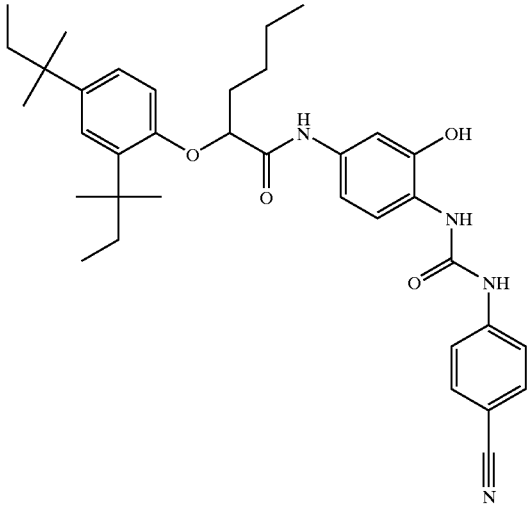

P2

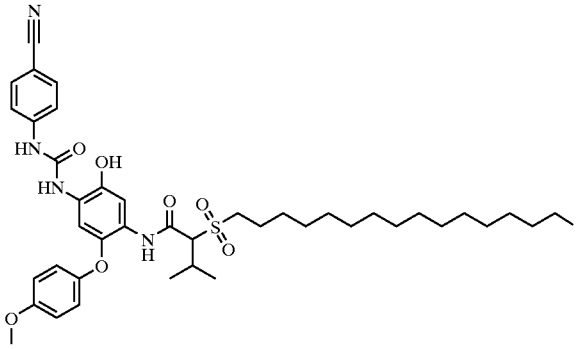

P3

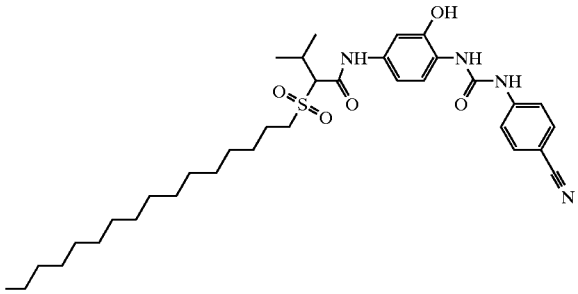

-continued

P4

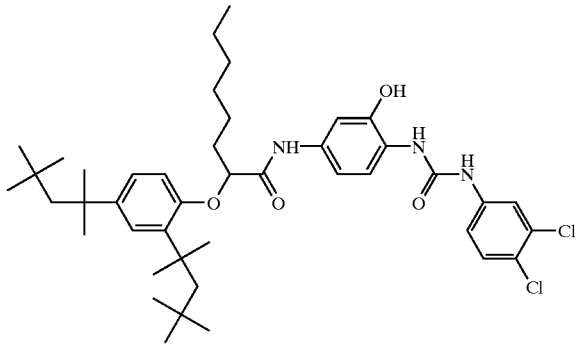

P5

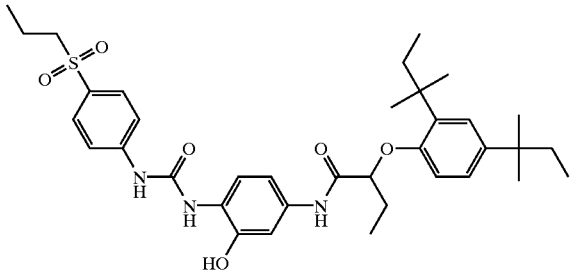

P6

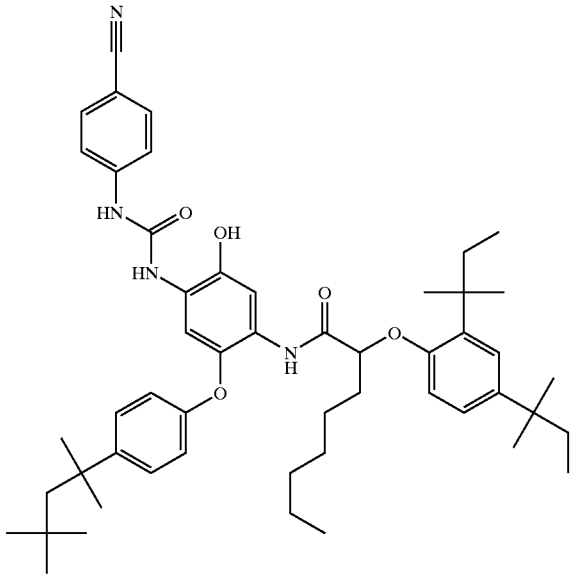

-continued
P7
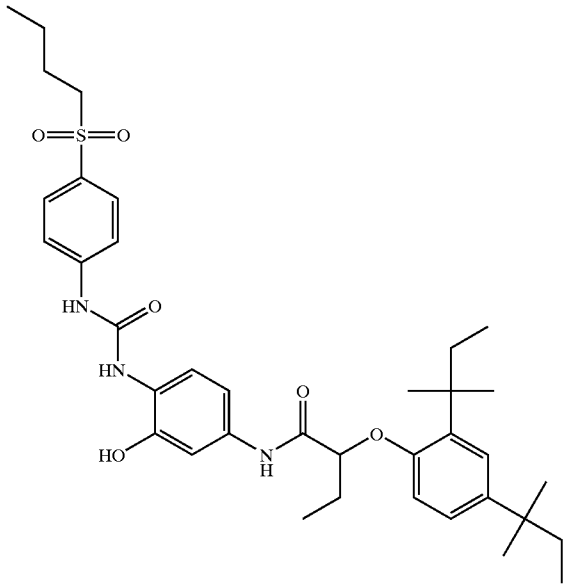
P8
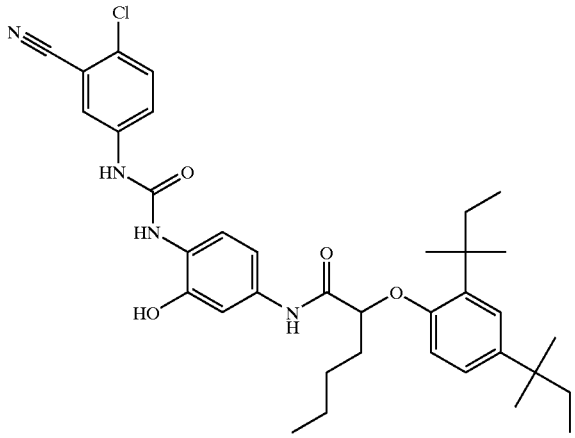
P9
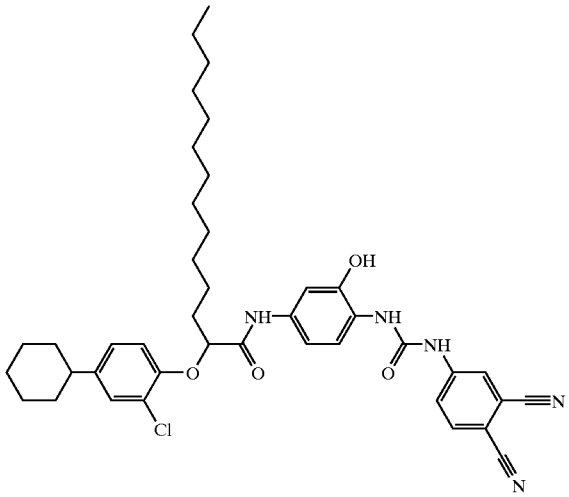
-continued
P10
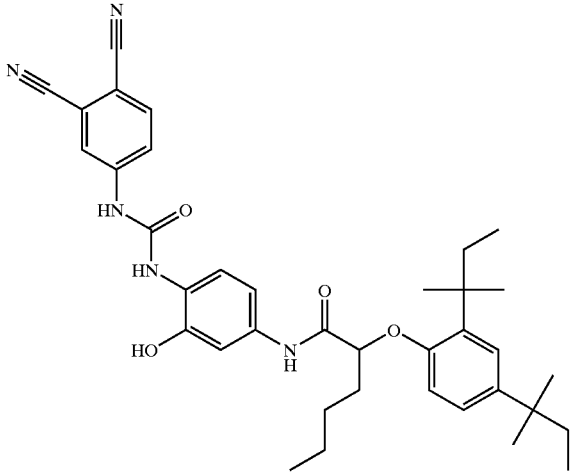
P11
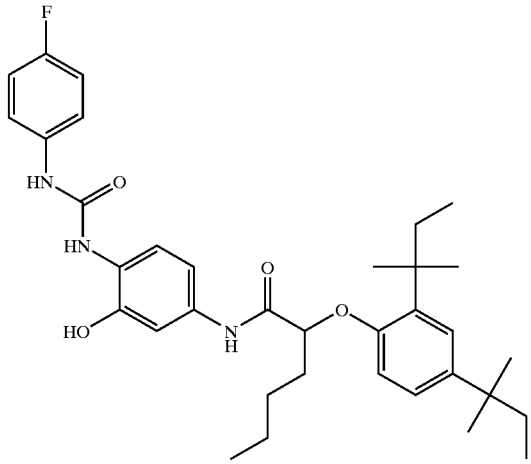
P12
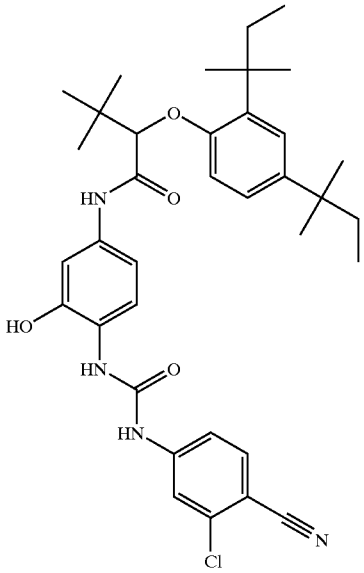

-continued
P13
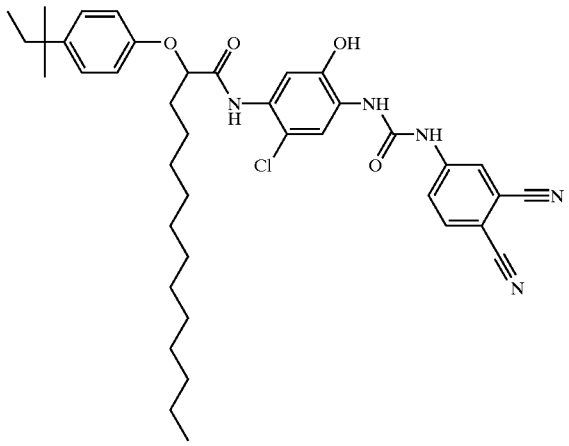
P14
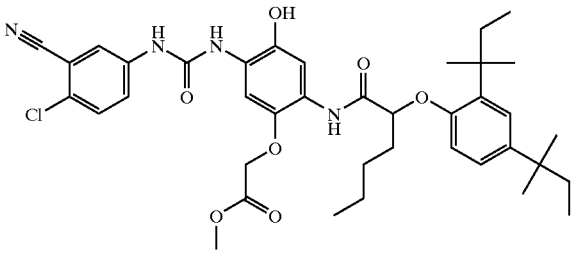
P15
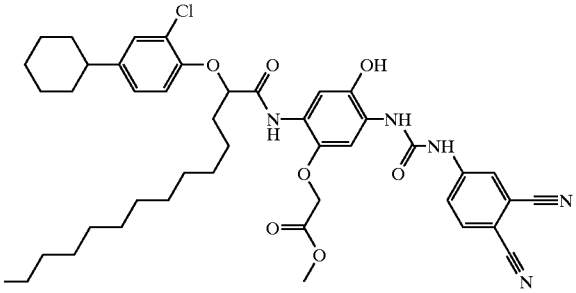
P16
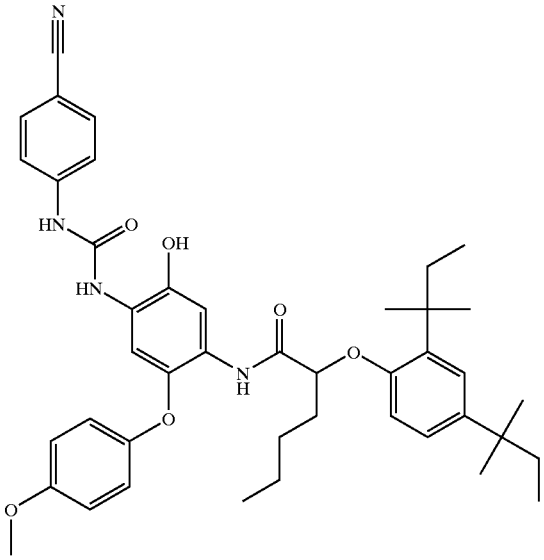
-continued
P17
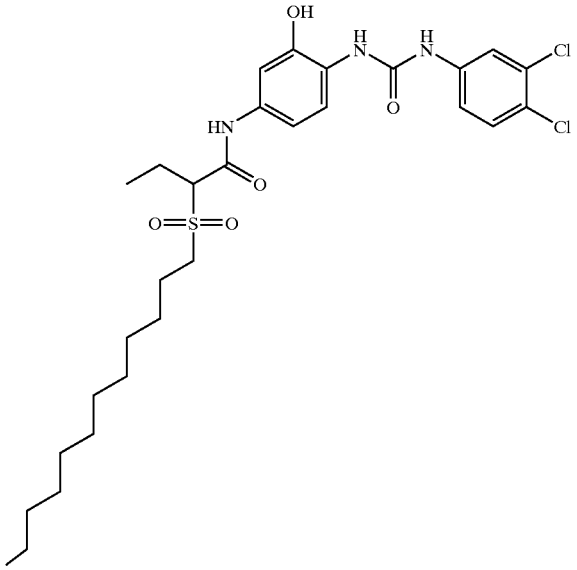
P18
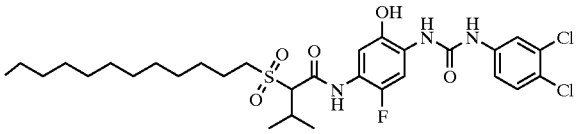
P19
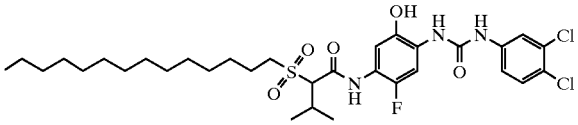
P20
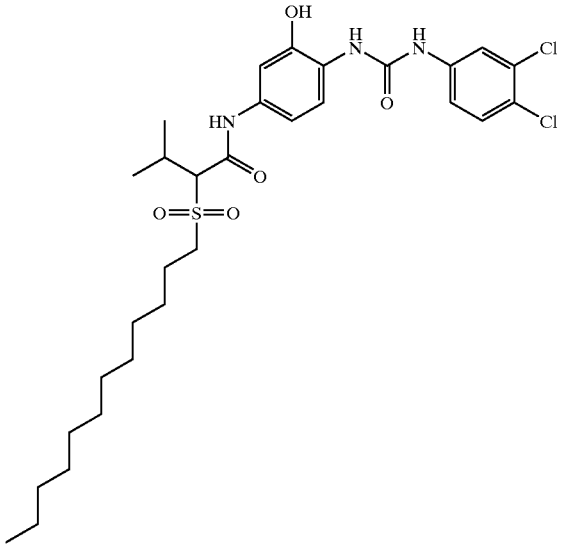

-continued

P21

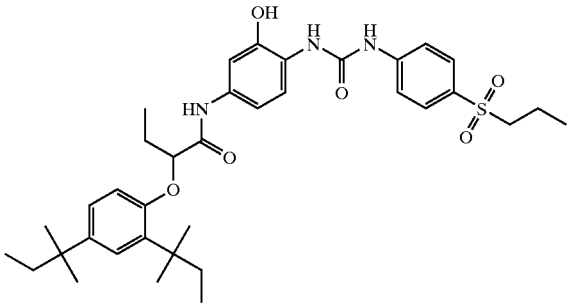

Cyan dye-forming couplers of Formula [P] above are be used in combination with a second cyan dye-forming coupler [AP] represented by either Formula [AP-I]:

[AP-I]

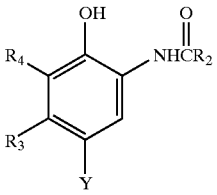

where $R_2$ represents a ballast group; $R_3$ represents an alkyl group (preferably of from 2 to 15 carbon atoms); $R_4$ represents a hydrogen or halogen atom (preferably a chloro atom) or an alkyl or an acylamino group (preferably of from 1 to 15 carbon atoms); and Y represents a hydrogen atom or coupling off group;

or Formula [AP-II]:

[AP-II]

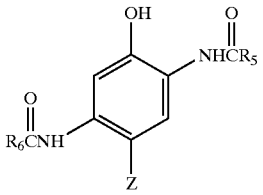

where $R_5$ and $R_6$ each represents an aliphatic group (preferably an aliphatic group having from 1 to 32 carbon atoms, e.g.; methyl, butyl, dodecyl, cyclohexylallyl), an aryl group (e.g., phenyl, naphthyl) or a heterocyclic group (e.g., 2-pyridyl, 2-imidazolyl, 2-furyl, 6-quinolyl), at least one of which is a ballast group.

It is understood throughout this specification that any reference to a substituent by the identification of a group containing a substitutable hydrogen, unless otherwise specifically stated, shall encompass not only the substituent's unsubstituted form, but also its form substituted with any other photographically useful substituents. For example, each such substitutable group can be substituted with one or more photographically acceptable substituents, such as those selected from an alkyl group, an aryl group, a heterocyclic group, an alkoxy group (e.g., methoxy, 2-methoxyethoxy), an aryloxy group (e.g., 2,4-di-tert-amyl phenoxy, 2-chlorophenoxy, 4-cyanophenoxy), an alkenyloxy group (e.g., 2-propenyloxy), an acyl group (e.g., acetyl, benzoyl), an ester group (e.g., butoxycarbonyl, phenoxycarbonyl, acetoxy, benzoyloxy, butoxysulfonyl, toluenesulfonyloxy), an amido group (e.g., acetylamino, methanesulfonylamino, dipropylsulfamoylamino), a carbamoyl group (e.g., dimethylcarbamoyl, ethylcarbamoyl), a sulfamoyl group (e.g., butylsulfamoyl), an imido group (e.g., succinimido, hydantoinyl), a ureido group (e.g., phenylureido, dimethylureido), an aliphatic or aromatic sulfonyl group (e.g., methanesulfonyl, phenylsulfonyl), an aliphatic or aromatic thio group (e.g., ethylthio, phenylthio), a hydroxy group, a cyano group, a carboxy group, a nitro group, a sulfo group, and a halogen atom. Usually the substituent will have less than 30 carbon atoms and typically less than 20 carbon atoms.

Representative couplers of Formula [AP-I] and [AP-II] include the following:

AP1
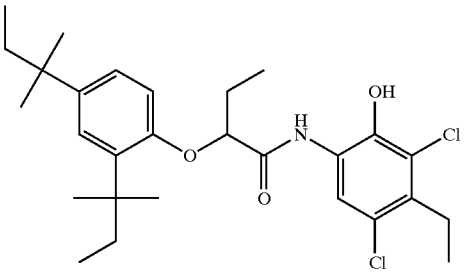
AP2
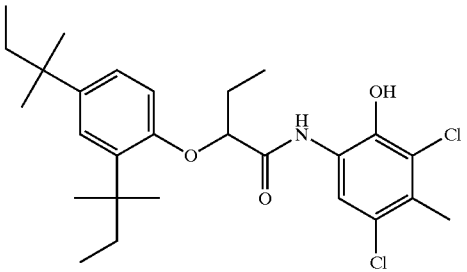
AP3
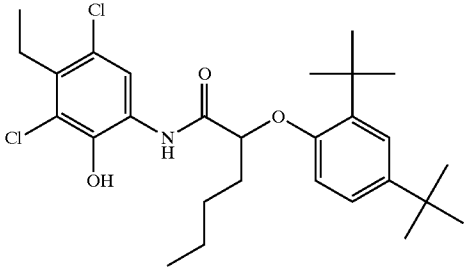
AP4
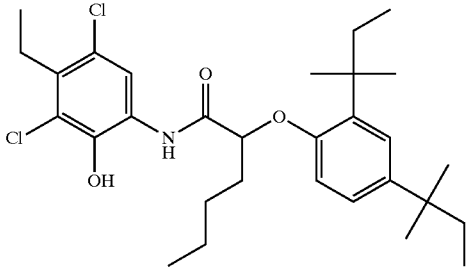
AP5
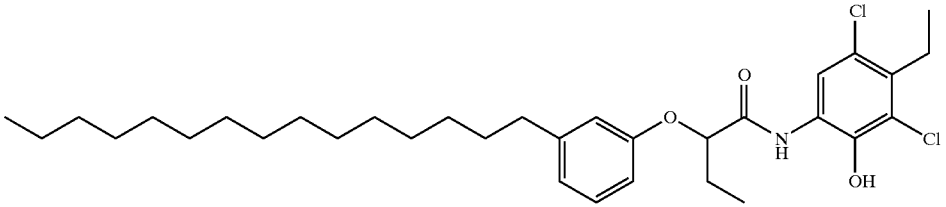
AP6
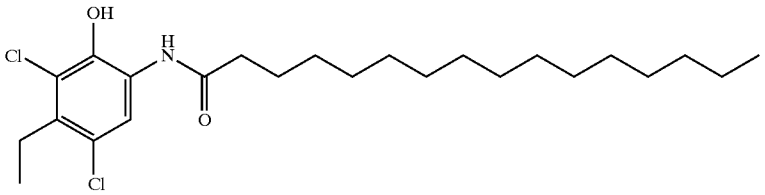

-continued
AP7
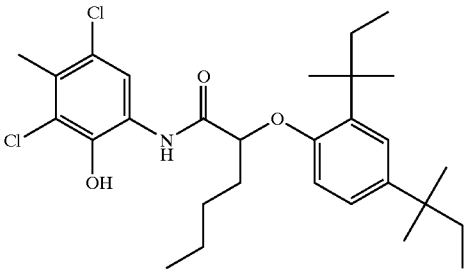
AP8
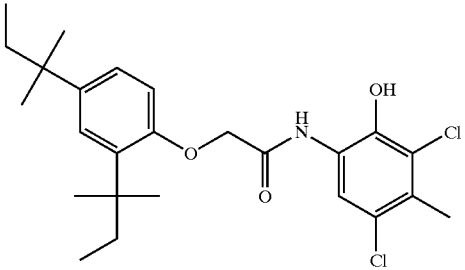
AP9
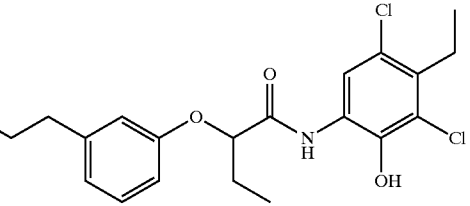
AP10
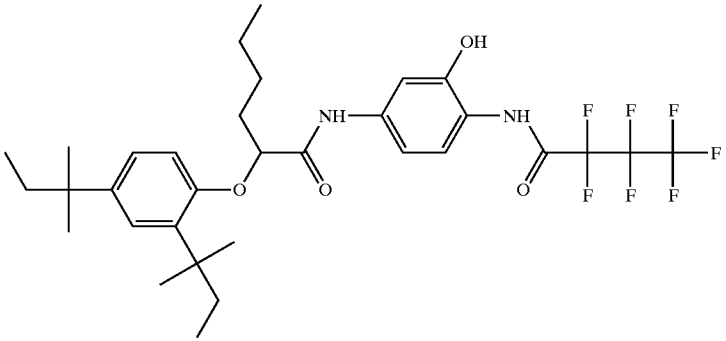

-continued
AP11
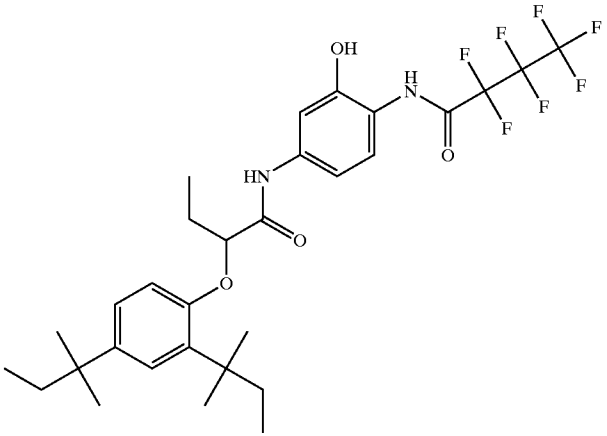
AP12
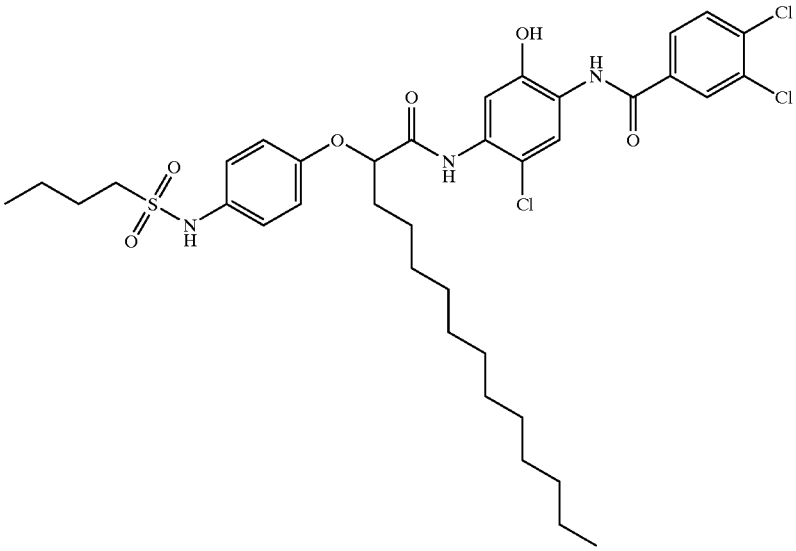

-continued
AP13
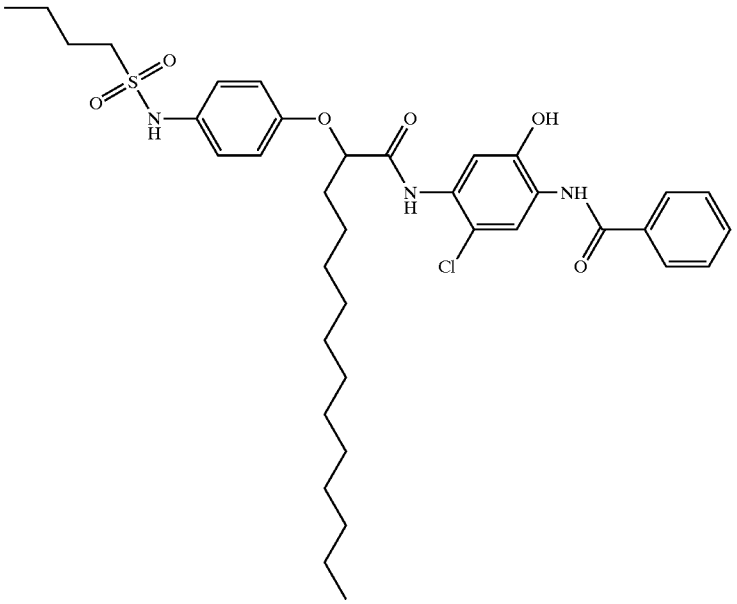
AP14
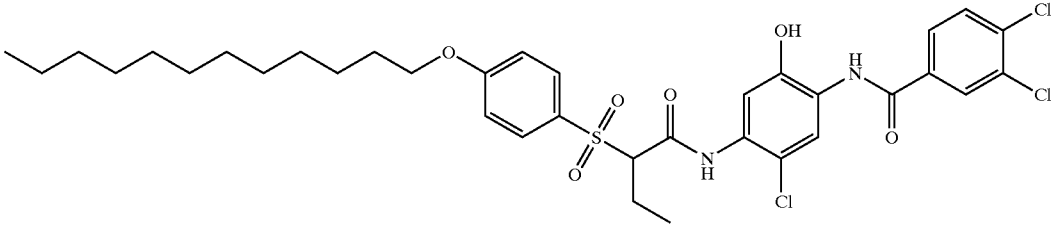
AP15
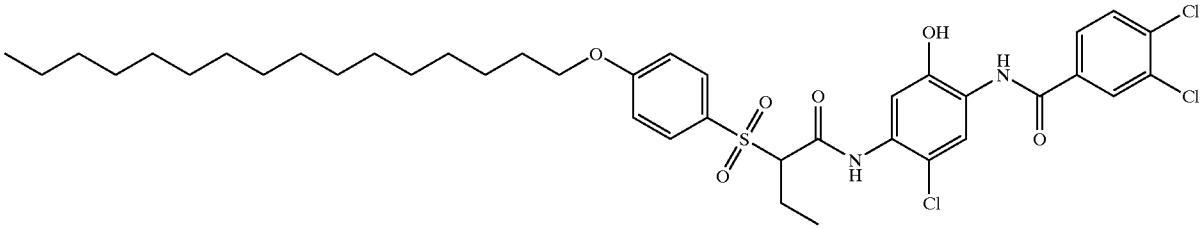

-continued
AP16
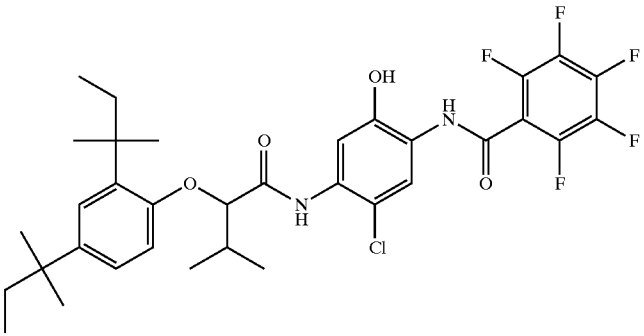
AP17
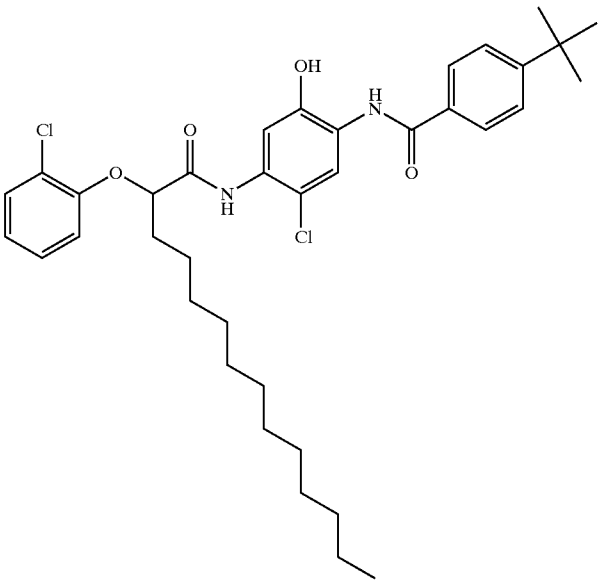

-continued
AP18
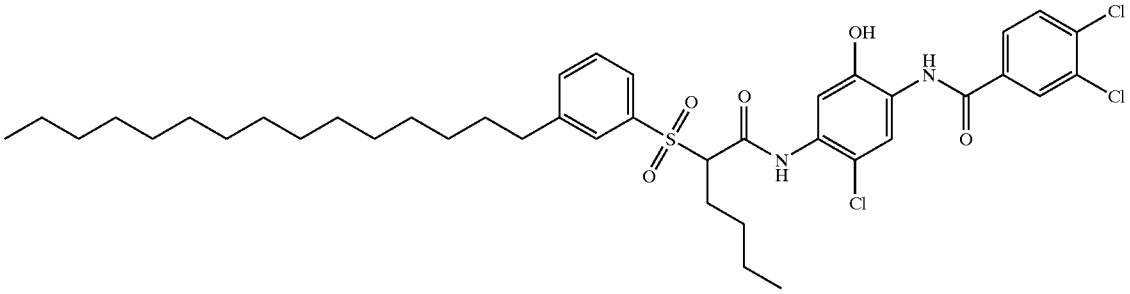
AP19
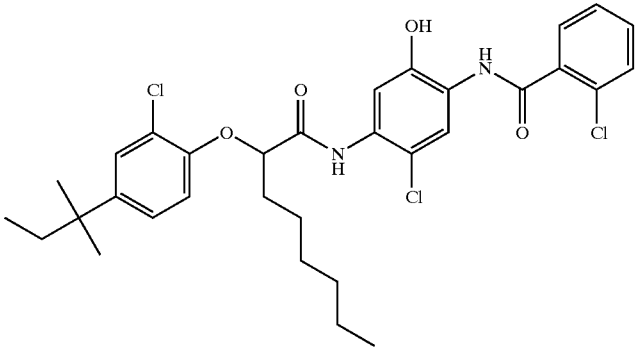
AP20
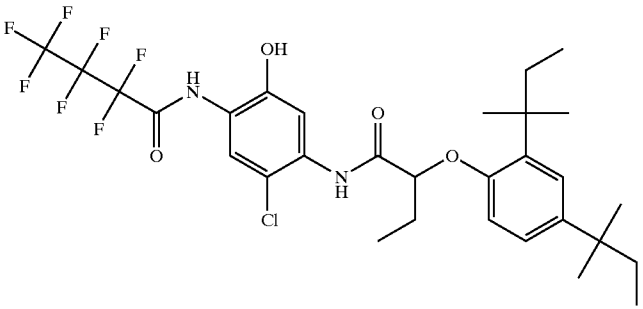

-continued
AP21
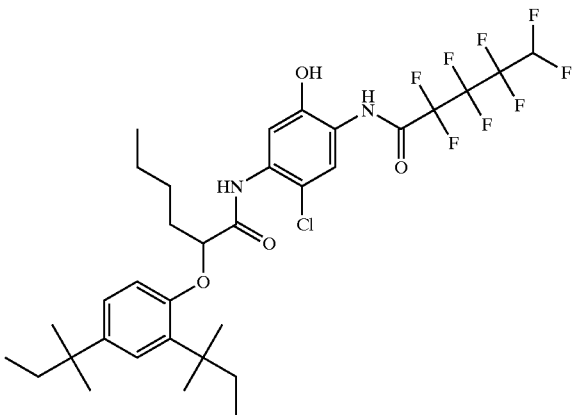
AP22
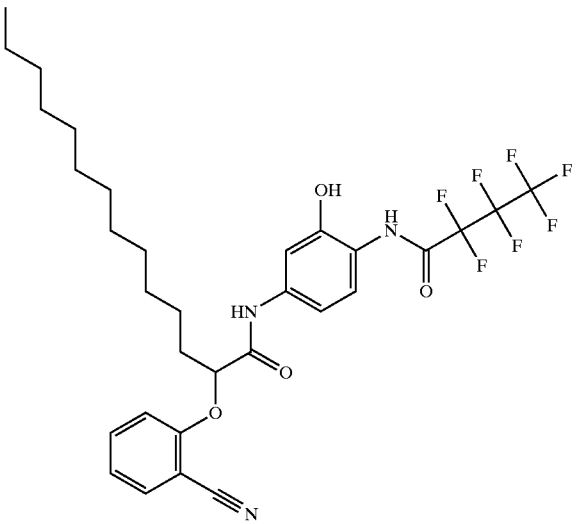

-continued
AP23
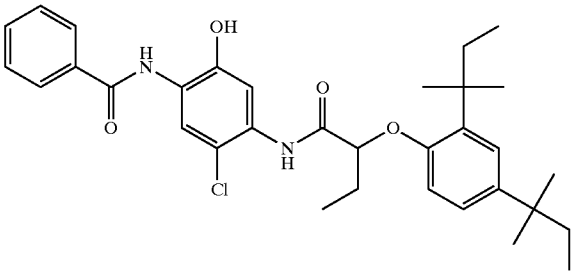
AP24
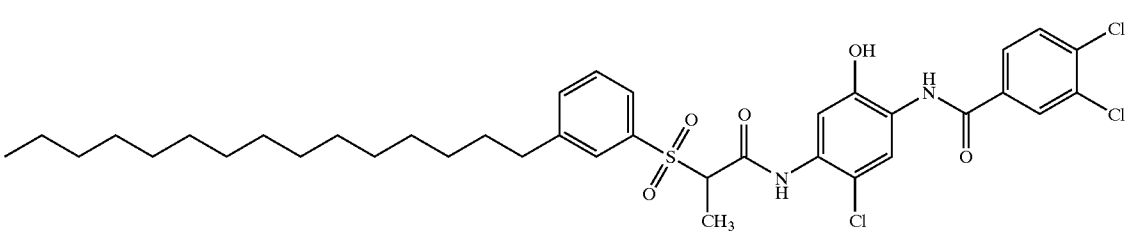

Further in combination with the cyan dye forming couplers of Formula [P] and either [AP-I] or [AP-II], a substantially non-color-developable phenolic activator compound represented by the Formula [ACT] is used in accordance with the invention:

[ACT]

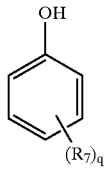

where q is from 1 to 3 and each $R_7$ independently represents an aliphatic group, a cycloalkyl group, an alkoxycarbonyl group, an aryloxycarbonyl group, an alkylcarbonyl group, an arylcarbonyl group, an acyloxy group, a sulfamoyl group, a sulfonamido group, a sulfonyl group, an aryl group, an alkoxy group, or a halogen atom. The term "substantially non-color-developable" in connection with the phenolic activator compound is intended to imply that, such phenolic compounds do not function effectively as dye forming couplers relative to the dye-forming activity of the compounds of formulae [P], [AP-I] and [AP-II]. More specifically, should a silver halide photographic light-sensitive material of this invention be prepared containing phenol cyan couplers of Formula [P] and substantially non-color-developable phenolic activator compounds relating to this invention in the same mole amount respectively in a silver halide emulsion layer of the light-sensitive material, and a KODAK FLEXICOLOR C-41 color developing process is applied to the silver halide photographic light-sensitive material, the color density of the non-color-developable phenolic activator compound should not be higher than one fortieth (1/40) of that of the phenol cyan coupler having Formula [P]. Selection of appropriate $R_7$ substituents to differentiate activator compounds from dye-forming coupler compounds will be apparent to one skilled in the art.

Preferably, $R_7$ substituents are chosen so as to result in a logarithmic octanol-water partition coefficient (log P) of at least 5.0 (more preferably at least 6.0) for the phenolic activator compound, in order to provide diffusion resistivity in coated photographic layers and prevent wandering of the compound from the cyan dye-forming couplers. The octanol-water partition coefficient is a physical property used extensively to describe a chemical's lipophilic or hydrophobic properties. It is the ratio of a chemical's concentration in the octanol-phase to its concentration in the aqueous phase of a two-phase system at equilibrium. Since measured values range from $<10^{-4}$ to $>10^{+8}$ (at least 12 orders of magnitude), the logarithm (log P) is commonly used to characterize its value. The Log Octanol-Water Partition Coefficient Program KOWWIN© Version 1.6, which is available from the U.S. Environmental Protection Agency via free internet download from the web-page "www.epa.gov/oppt/exposure/docs/episuitedl.htm", may be used to estimate the logarithmic octanol-water partition coefficient (log P) of organic compounds. KOWWIN requires only a chemical structure to estimate log P values. Structures are entered into KOWWIN by SMILES (Simplified Molecular Input Line Entry System) notations. The KOWWIN program and estimation methodology were developed at Syracuse Research Corporation. Meylan, W. M. and P. H. Howard, "Atom/fragment contribution method for estimating octanol-water partition coefficients", J. Pharm. Sci. 84: 83–92 (1995) describes the program methodology.

In Formula [ACT], $R_7$ substituent groups may be, e.g., an alkyl radical such as a straight- or branch-chained one preferably having one to 20 carbon atoms including a methyl radical, an ethyl radical, a t-butyl radical, a t-pentyl radical, a t-octyl radical, an n-nonyl radical, an n-dodecyl radical and the like; an alkenyl radical preferably having two to 20 carbon atoms, including an oleyl radical and the like; an aryl radical preferably including a phenyl radical, or a naphthyl radical; a cycloalkyl radical such as those preferably having five to seven carbon atoms, including a cyclohexyl radical; an alkylcarbonyl radical preferably a straight- or branch-chained one having one to 20 carbon atoms, including an acetyl radical; an arylcarbonyl radical preferably including a benzoyl radical; an alkoxycarbonyl radical such as a straight- or branch-chained alkoxycarbonyl radical preferably having one to 20 carbon atoms, including an acetoxy radical; an aryloxycarbonyl radical preferably including phenoxycarbonyl radical; or a cyano radical. Additional possible $R_7$ substituents, as long as they do not make the activator compound substantially color-developable, include a halogen including preferably chlorine and bromine; a heterocyclic radical preferably including a nitrogen-containing one; an alkoxy radical such as, preferably, a straight- or branch-chained alkoxy radical having one to 20 carbon atoms, including a methoxy radical, an ethoxy radical, a t-butyloxy radical, an n-octyloxy radical, an n-decyloxy radical, and an n-dodecyloxy radical; an aryloxy radical such as a phenoxy radical; a hydroxyl radical; an acyloxy radical such as, preferably, an alkylcarbonyloxy radical including an acetoxy radical, and an arylcarbonyloxy radical including a benzoyloxy radical; a hydroxycarbonyl radical; an alkylthio radical such as, preferably, those having one to 20 carbon atoms; an acyl radical such as, preferably, a straight- or branch-chained alkylcarbonyl radical and an arylcarbonyl radical such as preferably a phenyl carbonyl; an acylamino radical such as, preferably, a straight- or branch-chained alkylcarbamide radical having one to 20 carbon atoms, and a benzenecarbamide radical; a sulfonamide radical such as, preferably, a straight- or branch-chained alkylsulfonamide radical having one to 20 carbon atoms, and a benzenesulfonamide radical; a carbamoyl radical such as, preferably, a straight- or branch-chained alkylaminocarbonyl radical having one to 20 carbon atoms, and a phenylaminocarbonyl radical; a sulfonyl radical including a sulfamoyl radical such as, preferably, a straight- or branch-chained alkylaminosulfonyl radical having one to 20 carbon atoms, and a phenylaminosulfonyl radical; a nitro radical; an alkylsulfonyl radical such as preferably one having 1 to 20 carbon atoms. When the described $R_7$ groups may have a substituent, such substituents are, for example, an alkyl radical having one to ten carbon atoms, such as an ethyl radical, an i-propyl radical, an i-butyl radical, t-butyl radical, t-octyl radical or the like; an aryl radical such as a phenyl radical or a naphthyl radical; a halogen such as fluorine, chlorine, bromine or the like; a cyano radical; a nitro radical; a sulfonamide radical such as an alkylsulfonamide radical including a methanesulfonamide radical, a butanesulfonamide radical and the like, an arylsulfonamide radical including a p-toluenesulfonamide radical, or the like; a sulfamoyl radical such as an alkylsulfamoyl radical including a methylsulfamoyl radical, an arylsulfamoyl radical including a phenylsulfamoyl radical, and the like; a sulfonyl radical such as an alkylsulfonyl radical including a methanesulfonyl radical, an arylsulfonyl radical including a p-toluenesulfonyl radical, a halogenosulfonyl radical including a fluorosulfonyl radical, or the like; a carbamoyl radical such as an alkylcarbamoyl radical including a dimethylcarbamoyl radical, an arylcarbamoyl radical including a phenylcarbamoyl radical, or the like; an oxyearbonyl radical such as an alkyloxycarbonyl radical including an ethoxycarbonyl radical, an aryloxycarbonyl radical including a phenoxycarbonyl radical, or the like; an acyl radical such as an alkylcarbonyl radical including an acetyl radical and the like, an arylcarbonyl radical including a benzoyl radical, or the like; a heterocyclic radical such as a nitrogen- containing one including a pyridyl radical, a pyrazolyl radical and the like; an alkoxy radical; an aryloxy radical; an acyloxy radical; and the like. Substituents $R_7$ may themselves include phenolic groups, in which case the phenolic activator compounds may be composed of two or more phenols in combination.

In preferred embodiments, substituents $R_7$ have at least 7, more preferably from 7 to 40, and most preferably 7 to 32 carbon atoms in total, and at least one $R_7$ substituent group is preferably in the fourth position of the phenol ring (para position). The para $R_7$ substituent further preferably represent a straight- or branch-chained alkyl radical having one to 20 carbon atoms, an alkylcarbonyl or aryloxycarbonyl radical, or a sulfamoyl radical, including an arylsulfamoyl radical. Non-para $R_7$ substituents preferably are selected from the preferred para-substituents, and additionally from a nitro radical, an alkoxy radical, or a halogen atom. If the total carbon atoms for the $R_7$ substituents are not at least 7, the log P of the phenolic activator compound may be less than 5.0, and the compound may undesirably wander from coated photographic layers. If the total number of carbon atoms for the $R_7$ substituents are too large, it may become difficult to disperse and incorporate the compounds along with the dye-forming couplers into a silver halide emulsion layer.

The substantially non-color-developable phenolic activator compounds may be solid or liquid at ordinary room temperature (i.e., 25 C) and preferably have the boiling points of not lower than 150C at atmospheric pressure. Such compounds may be readily synthesized in a conventional and well-known process as described, for example, in U.S. Pat. No. 2,835, 579. There are also a number of such compounds which are commercially available. Further, representative synthesis examples are provided below. Representative compounds of Formula [ACT] which may be employed in accordance with the invention include the following, where the KOWWIN Log Octanol-Water Partition Coefficient Estimation Program was used to estimate logP for the activators (designated "log Kow"). For example ACT1: LogP (SRC Log Kow)=6.31. This denotes a distribution coefficient of approximately $2.0\times10^6$. High logP is a general indicator of low water solubility, and desirably lowered environmental risk.

| ACT (log Kow) | Structure |
|---|---|
| ACT1 (6.31) | 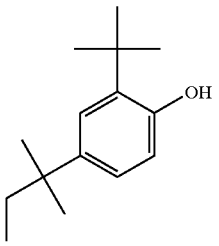 |
| ACT2 (6.54) | 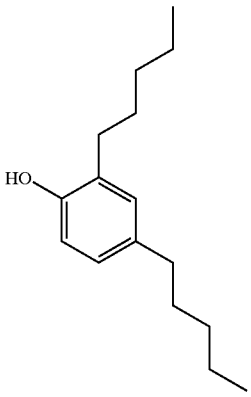 |

-continued
| ACT (log Kow) | Structure |
|---|---|
| ACT3 (7.97) | 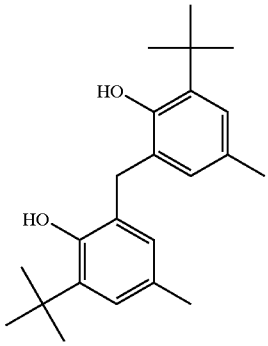 |
| ACT4 (5.33) | 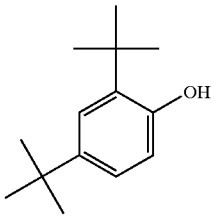 |
| ACT5 (5.03) | 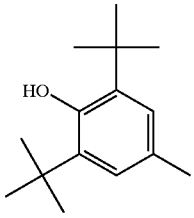 |
| ACT6 (8.05) | 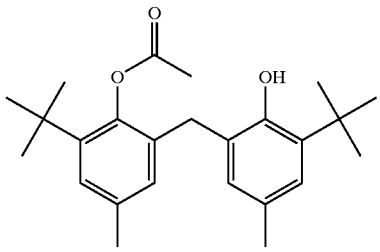 |
| ACT7 (10.01) | 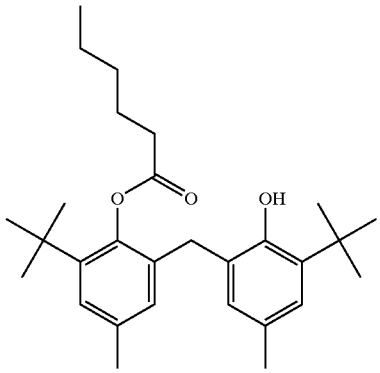 |

-continued
| ACT (log Kow) | Structure |
|---|---|
| ACT8 (5.88) | 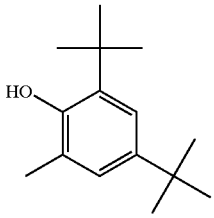 |
| ACT9 (7.00) | 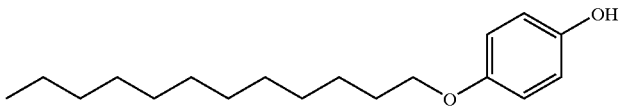 |
| ACT10 (7.46) | 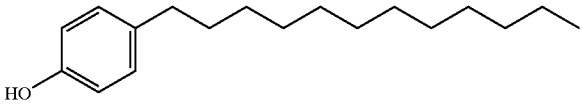 |
| ACT11 (5.50) | 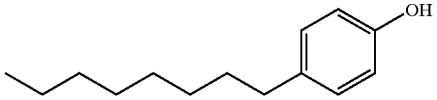 |
| ACT12 (5.01) | 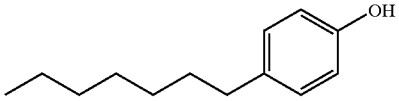 |
| ACT13 (8.94) | 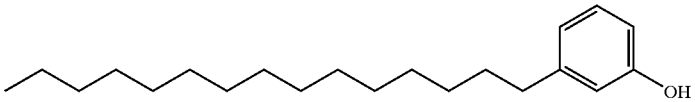 |
| ACT14 (8.62) | 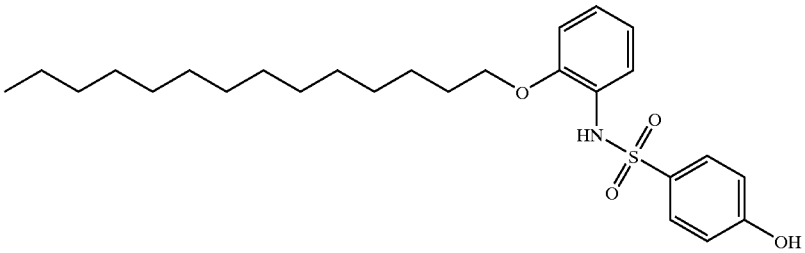 |
| ACT15 (5.99) | 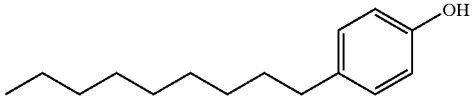 |
| ACT16 (7.46) | 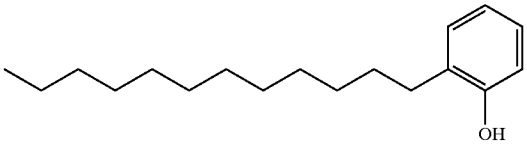 |
| ACT17 (8.18) | 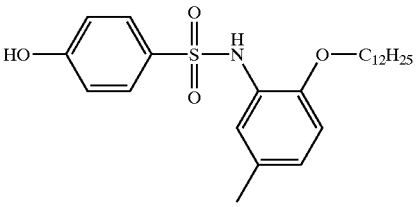 |

-continued
| ACT (log Kow) | Structure |
|---|---|
| ACT18 (10.00) | 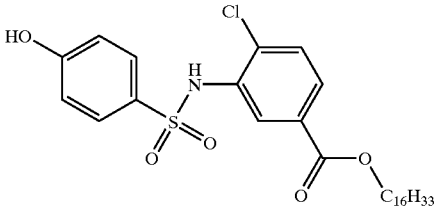 |
| ACT19 (8.03) | 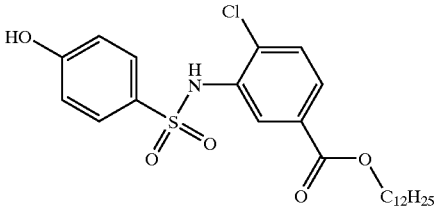 |
| ACT20 (8.01) | 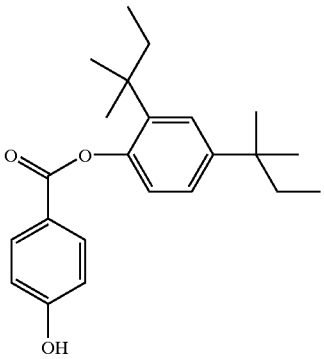 |
| ACT21 (9.35) | 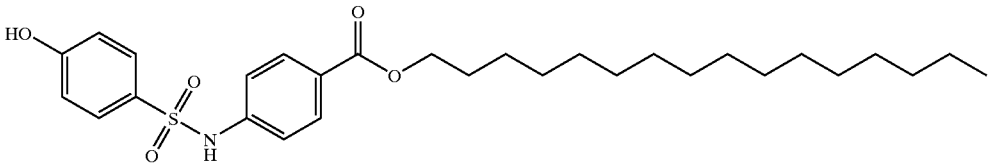 |
| ACT22 (9.16) | 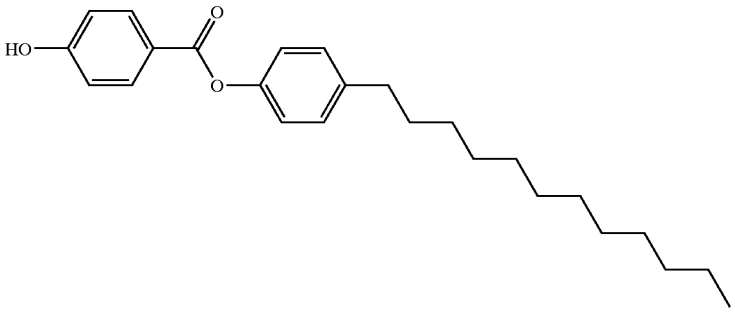 |
| ACT23 (5.48) | 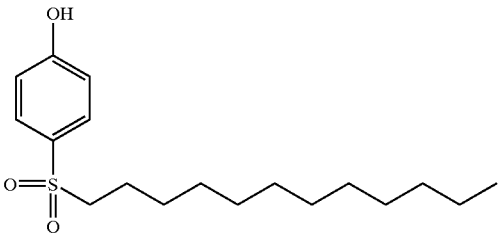 |

-continued
| ACT (log Kow) | Structure |
|---|---|
| ACT24 (6.03) | 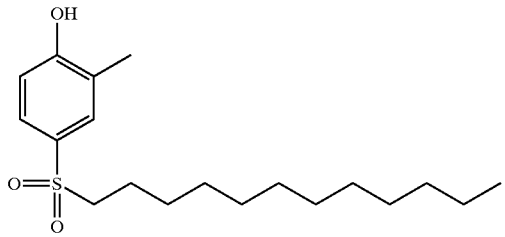 |
| ACT25 (8.62) | 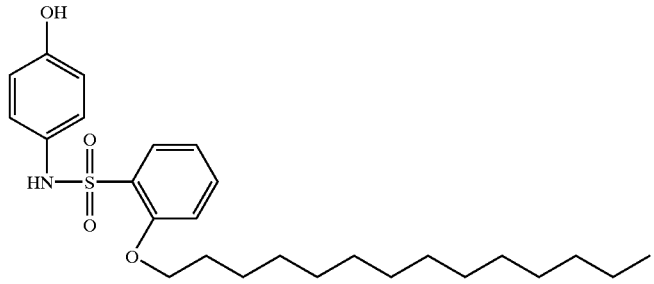 |
| ACT26 (10.55) | 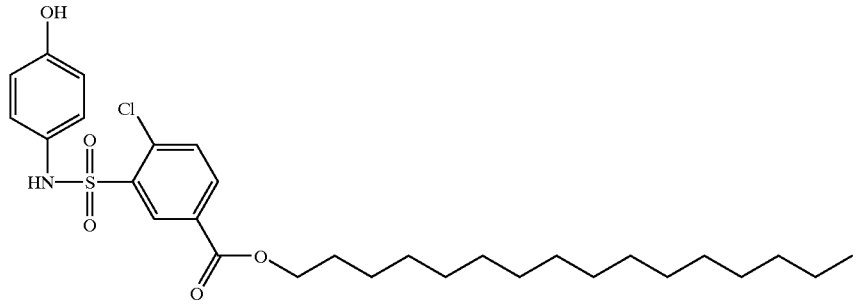 |
| ACT27 (10.98) | 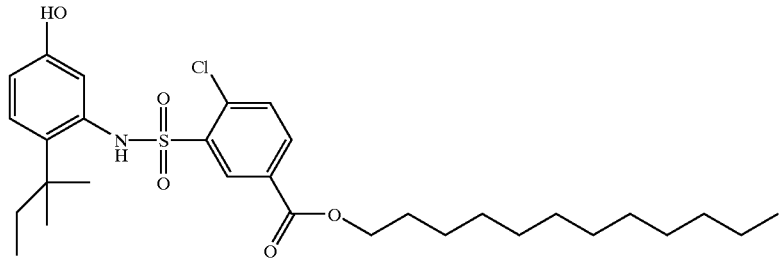 |
| ACT28 (8.55) | 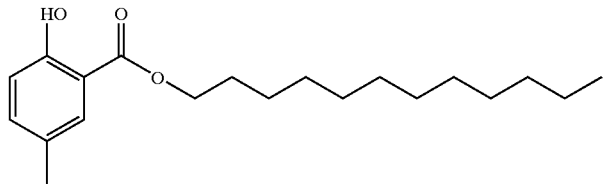 |

-continued

| ACT (log Kow) | Structure |
|---|---|
| ACT29 (7.58) | 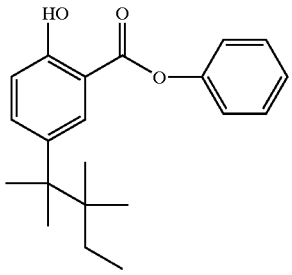 |
| ACT30 (13.12) | 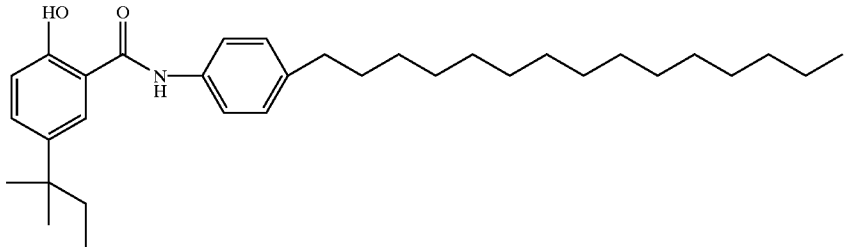 |
| ACT31 (8.20) | 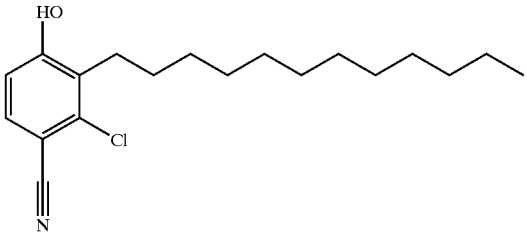 |
| ACT32 (7.40) | 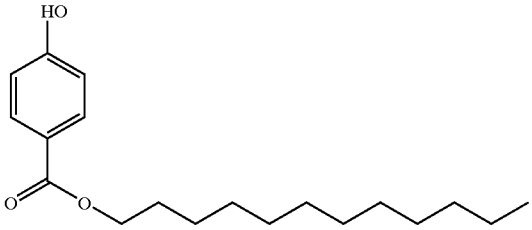 |
| ACT33 (4.52) | 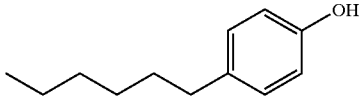 |
| ACT34 (4.52) | 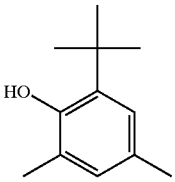 |
| ACT35 (3.42) | 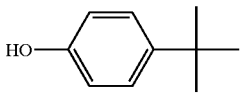 |

While non-color-developable phenolic compounds have been employed in the photographic art as coupler solvents themselves, their use as the sole coupler solvent with dye-forming couplers of Formula [P] and/or Formula [AP-I] or [AP-II] results in either lambda max or photographic activity levels undesired for color negative film applications. In accordance with the invention, to provide the desired combination of photographic activity and formed dye hue for color negative film applications while decreasing the level of coupler of Formula [P] needed to obtain such desired performance, the first cyan dye-forming coupler of Formula [P] is used in combination with the second phenolic cyan dye-forming coupler represented by [AP] (which comprises at least one of Formula [AP-I] or Formula [AP-II]), and the phenolic activator compound of Formula [ACT] in a coupler dispersion along with a high-boiling (boiling point of at least 150C) non-phenolic organic coupler solvent, wherein compounds represented by [P], [AP], and [ACT] are present in the coupler dispersion in relative weight fractions of from 0.30 to 0.65 (more preferably 0.50 to 0.60) for [P], from 0.15 to 0.35 (more preferably 0.20 to 0.25) for [AP], and from 0.15 to 0.35 (more preferably 0.20 to 0.25) for [ACT], provided the sum of the relative weight fractions for [P]+[AP]+[ACT]=1, and the weight ratio of the non-phenolic coupler solvent in the coupler dispersion is from 0.30 to 2.0 (more preferably 0.5 to 1.0) relative to the sum of [P]+[AP]+[ACT]. Use of a non-phenolic coupler solvent and the phenolic activator compound in combination with a coupler of Formula [P] and a second dye forming coupler of Formula [AP-I] or [AP-II] within the indicated ranges has been found to provide desired performance with decreased levels of coupler of Formula [P] in color negative film applications.

Representative non-phenolic coupler solvents which may be used in accordance with the invention include phthalic acid alkyl esters such as diundecyl phthalate, dibutyl phthalate, bis-2-ethylhexyl phthalate, and dioctyl phthalate, phosphoric acid esters such as tricresyl phosphate, diphenyl phosphate, tris-2-ethylhexyl phosphate, and tris-3,5,5-trimethylhexyl phosphate, citric acid esters such as tributylcitrate, tributyl acetylcitrate, 2-(2-butoxyethoxy) ethyl acetate, and 1,4-cyclohexyldimethylene bis(2-ethylhexanoate), benzoic acid esters such as octyl benzoate, aliphatic amides such as N,N-diethyl lauramide, N,N-diethyldodecanamide, N,N-dibutyldodecanamide, mono and polyvalent alcohols such as oleyl alcohol and glycerin monooleate, and aliphatic dioic acid alkyl esters such as dibutyl sebacate and other diesters of the formula R—$(CH_2)_m$—R' wherein R and R' each represent an alkoxycarbonyl group containing not more than 8 carbon atoms and m is an integer of from 1 to 10. Preferred non-phenolic coupler solvents for use in the invention are the phthalic acid alkyl esters and aliphatic dioic acid alkyl esters, which can be used alone or in combination with one another or with other coupler solvents.

Dispersions of cyan image forming couplers for use in the invention can be prepared by dissolving the couplers and phenolic activator compounds in the non-phenolic high boiling solvent, optionally with or without low boiling or partially water soluble auxiliary organic solvents. The resulting liquid organic phase may then be mixed with an aqueous gelatin solution, and the mixture is then passed through a mechanical mixing device suitable for high shear or turbulent mixing generally suitable for preparing photographic emulsified dispersions, such as a colloid mill, homogenizer, microfluidizer, high speed mixer, ultrasonic dispersing apparatus, blade mixer, device in which a liquid stream is pumped at high pressure through an orifice or interaction chamber, Gaulin mill, blender, etc., to form small particles of the organic phase suspended in the aqueous phase. More than one type of device may be used to prepare the dispersions. The auxiliary organic solvent, if present, may then be removed by evaporation, noodle washing, or membrane dialysis. If not removed prior to coating in a photographic element layer, partially water soluble auxiliary organic solvents may diffuse throughout the hydrophilic colloid layers of the element, and be removed during photographic processing. The dispersion particles preferably have an average particle size of less than 2 microns, generally from about 0.02 to 2 microns, more preferably from about 0.02 to 0.5 micron. These methods are described in detail in U.S. Pat. Nos. 2,322,027, 2,787,544, 2,801,170, 2,801,171, 2,949,360, and 3,396,027. Useful coated levels of the dye-forming couplers range from about 0.1 to about 5.00 g/sq m, or more typically from 0.2 to 3.00 g/sq m. Examples of suitable auxiliary solvents which can be used include: ethyl acetate, isopropyl acetate, butyl acetate, ethyl propionate, 2-ethoxyethylacetate, 2-(2-butoxyethoxy) ethyl acetate, triethylcitrate, dimethylformamide, 2-methyl tetrahydrofuran, triethylphosphate, cyclohexanone, butoxyethyl acetate, methyl isobutyl ketone, methyl acetate, 4-methyl-2-pentanol, diethyl carbitol, 1,1,2-trichloroethane, 1,2-dichloropropane, and the like. Preferred auxiliary solvents include ethyl acetate and 2-(2-butoxyethyoxy) ethyl acetate.

The aqueous phase of the coupler dispersions preferably comprise gelatin as a hydrophilic colloid. This may be gelatin or a modified gelatin such as acetylated gelatin, phthalated gelatin, oxidized gelatin, deionized gelatin, etc. Gelatin may be base-processed, such as lime-processed gelatin, or may be acid-processed, such as acid processed ossein gelatin. Other hydrophilic colloids may also be used, such as a water soluble polymer or copolymer including, but not limited to poly(vinyl alcohol), partially hydrolyzed poly(vinylacetate-co-vinyl alcohol), hydroxyethyl cellulose, poly(acrylic acid), poly(1-vinylpyrrolidone), poly(sodium styrene sulfonate), poly(2-acrylamido-2-methane sulfonic acid), polyacrylamide. Copolymers of these polymers with hydrophobic monomers may also be used.

Typically, the cyan dye-forming coupler dispersion is incorporated in a melt and coated as a layer described herein on a support to form part of a photographic element. When the term "associated" is employed, it signifies that a reactive compound is in or adjacent to a specified layer where, during processing, it is capable of reacting with other components. Most typically, cyan dye-forming coupler dispersions will be dispersed in a red-light sensitive layer of a photographic element.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, and subbing layers.

If desired, the photographic element can be used in conjunction with an applied magnetic layer as described in

*Research Disclosure*, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1996, Item 38957, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

Suitable silver halide emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. Certain desirable photographic elements and processing steps are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, and color correction. The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl such as oxazolidinyl or hydantoinyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in U.K. Patents and published application Nos. 1,466,728, 1,531,927, 1,533,039, 2,006,755A and 2,017,704A, the disclosures of which are incorporated herein by reference.

Image dye-forming couplers may be included in the element in addition to the cyan dye-forming couplers of Formulae [P], [AP-I], and [AP-II] above, such as additional couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, 3,758,309, 4,540,654, and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized and color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine LiteratureUbersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: U.K. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; U.K. Patent 1,530,272; and Japanese Application 58-113935. The masking couplers may be shifted or blocked, if desired.

Typically, couplers are incorporated in a silver halide emulsion layer in a mole ratio to silver of 0.05 to 1.0 and generally 0.1 to 0.5. Usually the couplers are dispersed in a high-boiling organic solvent in a weight ratio of solvent to coupler of 0.1 to 10.0 and typically 0.1 to 2.0, although dispersions using no permanent coupler solvent are sometimes employed.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613. Such compounds are also disclosed in "Developer-Inhibitor-Releasing (DIR) Couplers for Color Photography," C. R. Barr, J. R. Thirtle and P. W. Vittum in *Photographic Science* and *Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

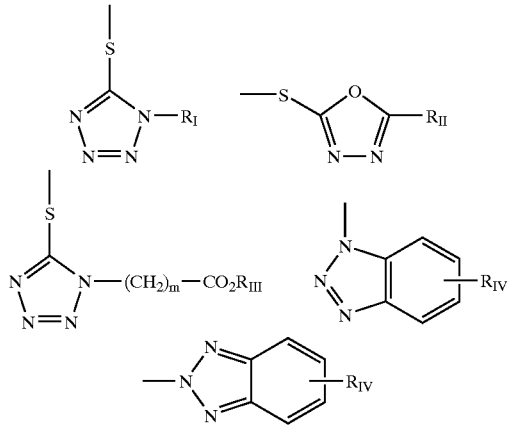

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a photographically useful group ("PUG") directly upon reaction of the compound during processing, or indirectly through a timing or linking group. A timing group produces the time-delayed release of the PUG such as groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. No. 4,438,193; U.S. Pat. No. 4,618,571) and groups that combine the features describe above. It is typical that the timing group is of one of the formulas:

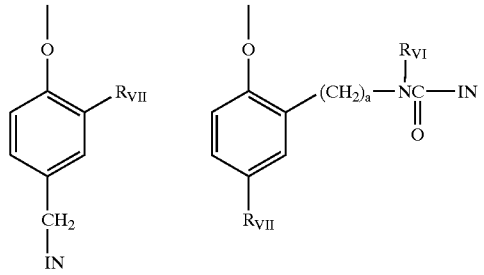

wherein IN is the inhibitor moiety, $R_{VII}$ is selected from the group consisting of nitro, cyano, alkylsulfonyl; sulfamoyl; and sulfonamido groups; a is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers for use in the present invention include, but are not limited to, the following:

D1

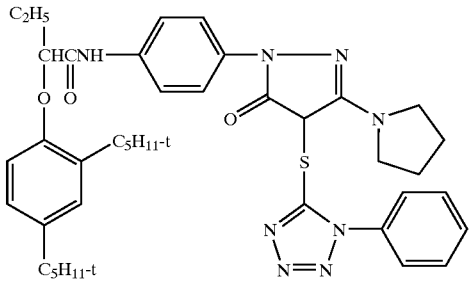

D2

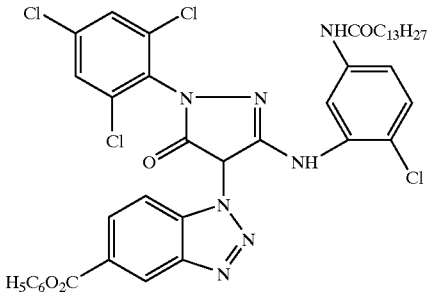

-continued

D3

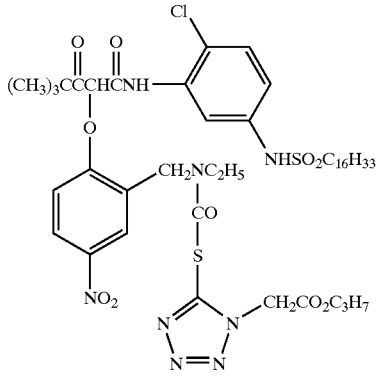

D4

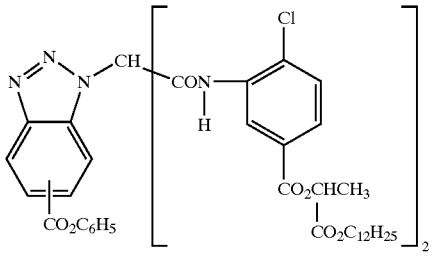

D5

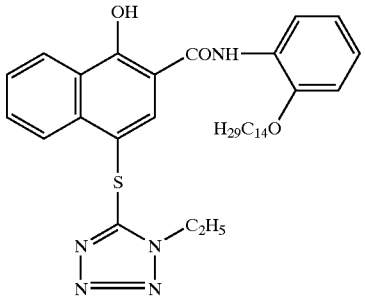

D6

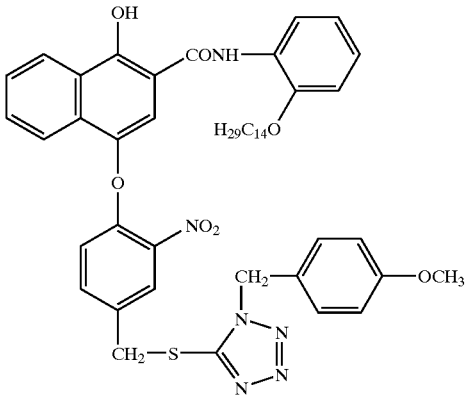

D7
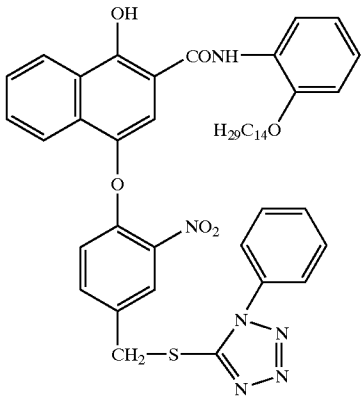
D8
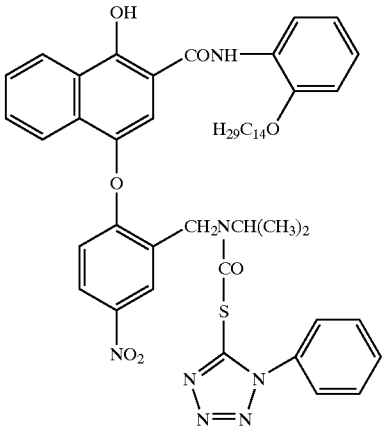
D9
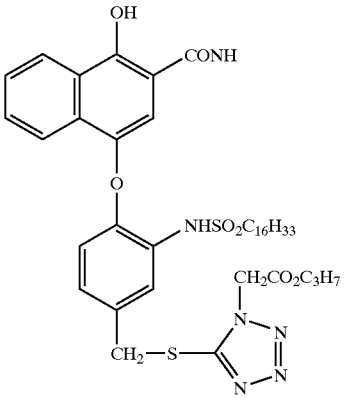
D10
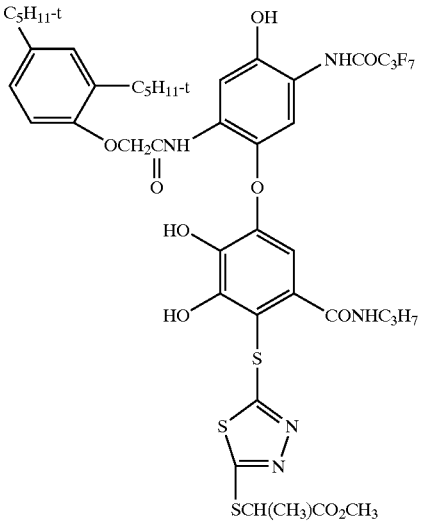
D11
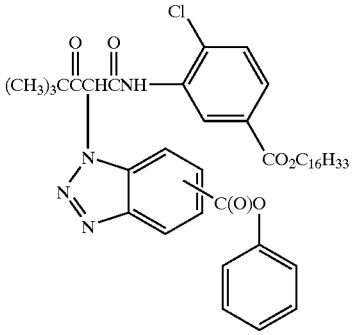
D12
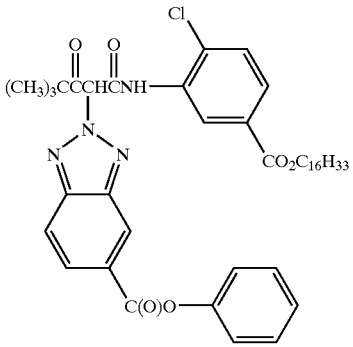

Especially useful in this invention are tabular grain silver halide emulsions. Tabular grains are those having two parallel major crystal faces and having an aspect ratio of at least 2. The term "aspect ratio" is the ratio of the equivalent circular diameter (ECD) of a grain major face divided by its thickness (t). Tabular grain emulsions are those in which the tabular grains account for at least 50 percent (preferably at least 70 percent and optimally at least 90 percent) of the total grain projected area. Preferred tabular grain emulsions are those in which the average thickness of the tabular grains is less than 0.3 micrometer (preferably thin—that is, less than 0.2 micrometer and most preferably ultrathin—that is, less than 0.07 micrometer). The major faces of the tabular grains can lie in either {111} or {100} crystal planes. The mean ECD of tabular grain emulsions rarely exceeds 10 micrometers and more typically is less than 5 micrometers.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435,501, 4,463,087 and 4,173,320, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061,609, Tsaur et al U.S. Pat. Nos. 5,147,771, '772, '773, 5,171,659 and 5,252,453, Black et al 5,219,720 and 5,334,495, Delton U.S. Pat. Nos. 5,310,644, 5,372,927 and 5,460,934, Wen U.S. Pat. No. 5,470,698, Fenton et al U.S. Pat. No. 5,476,760, Eshelman et al U.S. Pat. Nos. 5,612,175 and 5,614,359, and Irving et al U.S. Pat. No. 5,667,954.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No. 5,667,955.

High bromide {100} tabular grain emulsions are illustrated by Mignot U.S. Pat. Nos. 4,386,156 and 5,386,156.

High chloride {111} tabular grain emulsions are illustrated by Wey U.S. Pat. No. 4,399,215, Wey et al U.S. Pat. No. 4,414,306, Maskasky U.S. Pat. Nos. 4,400,463, 4,713,323, 5,061,617, 5,178,997, 5,183,732, 5,185,239, 5,399,478 and 5,411,852, and Maskasky et al U.S. Pat. Nos. 5,176,992 and 5,178,998. Ultrathin high chloride {111} tabular grain emulsions are illustrated by Maskasky U.S. Pat. Nos. 5,271,858 and 5,389,509.

High chloride {100} tabular grain emulsions are illustrated by Maskasky U.S. Pat. Nos. 5,264,337, 5,292,632, 5,275,930 and 5,399,477, House et al U.S. Pat. No. 5,320,938, Brust et al U.S. Pat. No. 5,314,798, Szajewski et al U.S. Pat. No. 5,356,764, Chang et al U.S. Pat. Nos. 5,413,904 and 5,663,041, Oyamada U.S. Pat. No. 5,593,821, Yamashita et al U.S. Pat. Nos. 5,641,620 and 5,652,088, Saitou et al U.S. Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform-light exposure or in the presence of a nucleating agent. Tabular grain emulsions of the latter type are illustrated by Evans et al. U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. One type of such element, referred to as a color negative film, is designed for image capture. Speed (the sensitivity of the element to low light conditions) is usually critical to obtaining sufficient image in such elements. Such elements are typically silver bromoiodide emulsions coated on a transparent support and are sold packaged with instructions to process in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3' 15" or less and desirably 90 or even 60 seconds or less.

The photographic element of the invention can be incorporated into exposure structures intended for repeated use or exposure structures intended for limited use, variously referred to by names such as "single use cameras", "lens with film", or "photosensitive material package units".

Preferred color developing agents are p-phenylenediamines such as: 4-amino-N,N-diethylaniline hydrochloride; 4-amino-3-methyl-N,N-diethylaniline hydrochloride; 4-amino-3-methyl-N-ethyl-N-(2-methanesulfonamidoethyl)aniline sesquisulfate hydrate; 4-amino-3-methyl-N-ethyl-N-(2-hydroxyethyl)aniline sulfate; 4-amino-3-(2-methanesulfonamidoethyl)-N,N-diethylaniline hydrochloride; and 4-amino-N-ethyl-N-(2-methoxyethyl)-m-toluidine di-p-toluene sulfonic acid. Development is usually followed by the conventional steps of bleaching, fixing, or bleach-fixing, to remove silver or silver halide, washing, and drying.

The entire contents of the patents and other publications cited in this specification are incorporated herein by reference.

SYNTHESIS EXAMPLES

Scheme 1
Synthesis of ACT14

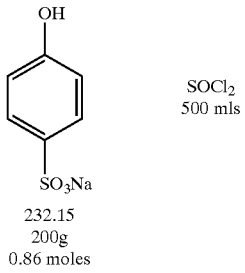

-continued

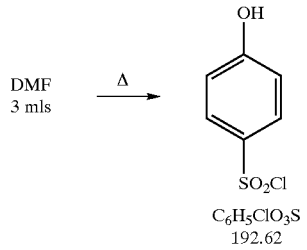

4-Hydroxybenzenesulfonic acid sodium salt dihydrate was added portionwise to a mechanically stirred solution of thionyl chloride. After≈half to three quarters of the sulfonic acid had been added, vigorous bubbling occurred and was contained in the flask and lasted about two to three minutes. When bubbling subsided, the remaining phenol was added portionwise. After addition, the reaction was heated to reflux for six hours. The heat was turned off and the solution was allowed to stir overnight. The solution was then poured into a mixture of ice and water with vigorous stirring. Added 1500 mls of ethyl acetate and continued to stir for another five or ten minutes. The layers were separated. The water layer was discarded. The ethyl acetate layer was dried with magnesium sulfate and concentrated to an oil. This was used without further purification in the next step.

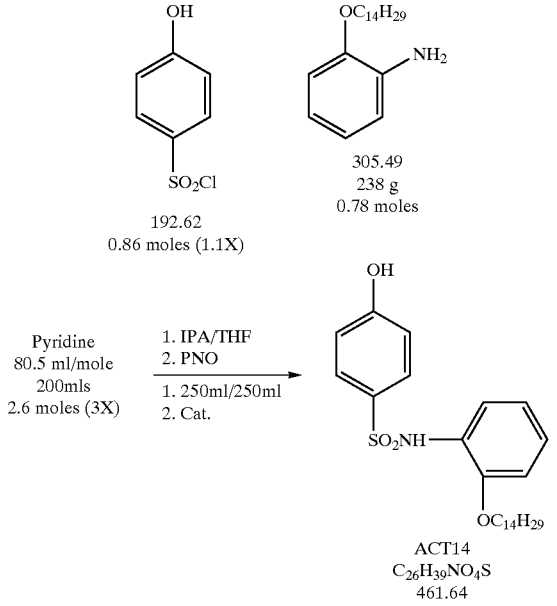

The aniline was slurried in a mechanically stirred solution of isopropyl alcohol and THF. Pyridine was added and the solid went into solution. Pyridine N-oxide, one spatula full, was added, then the sulfonyl chloride in a little THF was added in one portion. An exotherm was noticed. Stirred≈thirty minutes. TLC shows no starting material one major new spot. Poured into a mixture of ethyl acetate and dilute HCl. Extracted into the ethyl acetate. This was dried with magnesium sulfate and concentrated to near dryness. A solid precipitated. This was diluted with heptane and filtered. The solid was recrystallized from heptane to give 305 grams (77%) over two steps. MP=88–90° C.; NMR is consistent with the expected structure; MS=ES$^-$ 921 (dimer) ES$^+$ 462; HPLC=99.5%.

Scheme 2
Synthesis of ACT20

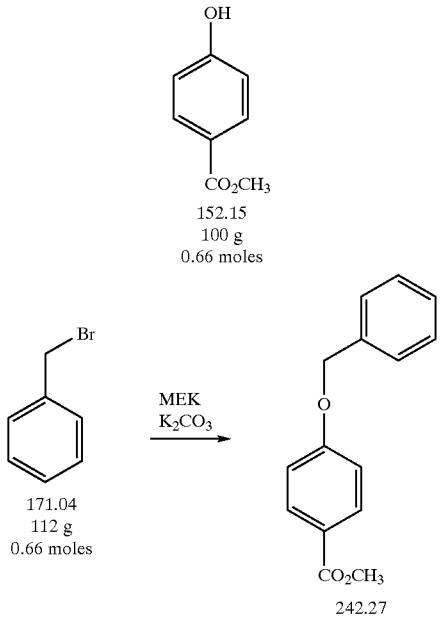

Methyl-1-hydroxy benzoate (Aldrich #M5,010-9) was mechanically stirred in 2-butanone. Benzyl bromide and potassium carbonate were added. The reaction was then heated to reflux for 3 hours. TLC shows no starting material and one new spot. Cooled slightly and poured into a stirred mixture of ice and water (4 liters). The solid that formed was filtered and air dried overnight. This was used without further purification in the next reaction.

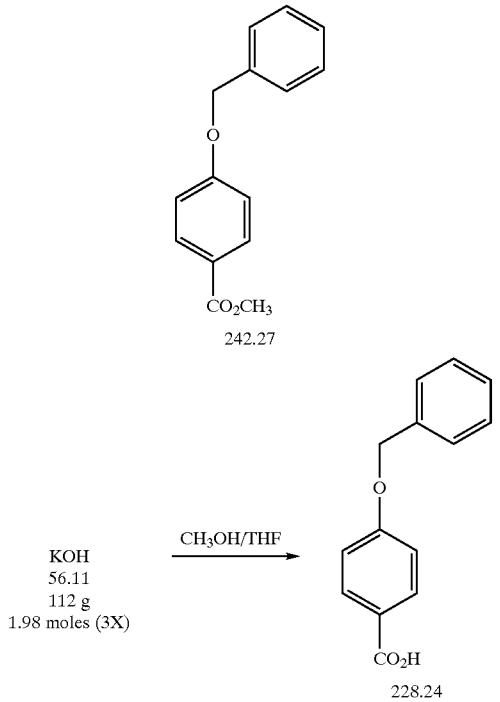

A mechanically stirred slurry of the ester in methanol and THF was treated in one portion with KOH in 300 mls of water The resulting slurry was heated until everything was in solution. Stirred hot for 30 minutes. TLC shows no starting material and one new spot. Cooled slightly, and added a mixture of 250 mls of concentrated HCl and 3000 mls of water. The resulting solid was filtered and recrystallized from acetonitrile to give 123.8 grams (94.2%) as a white solid.

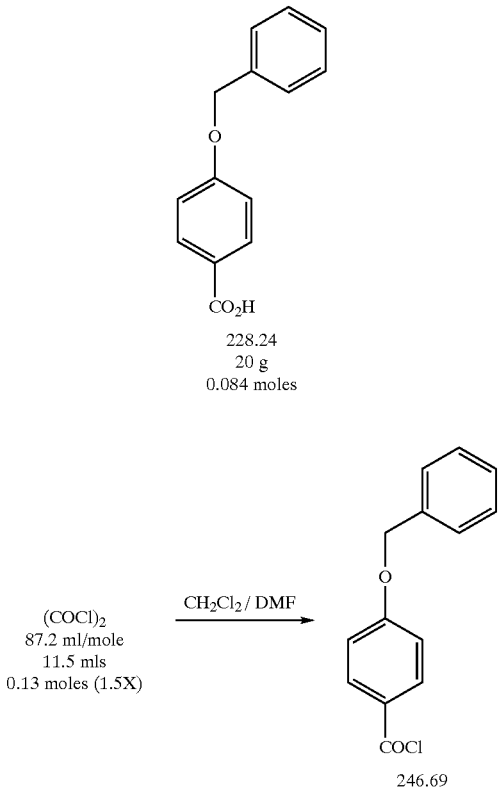

The acid was slurried in dichloromethane with a catalytic amount of DMF present. To this, oxalyl chloride was added dropwise. Bubbling began almost immediately. Within 30 minutes, the solid was in solution. Stirred at room temperature until bubbling stopped, then warmed to a gentle reflux until bubbling stopped again. Concentrated on a roto evaporator to a solid. This was used without further purification in the next reaction.

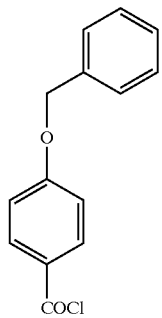

-continued

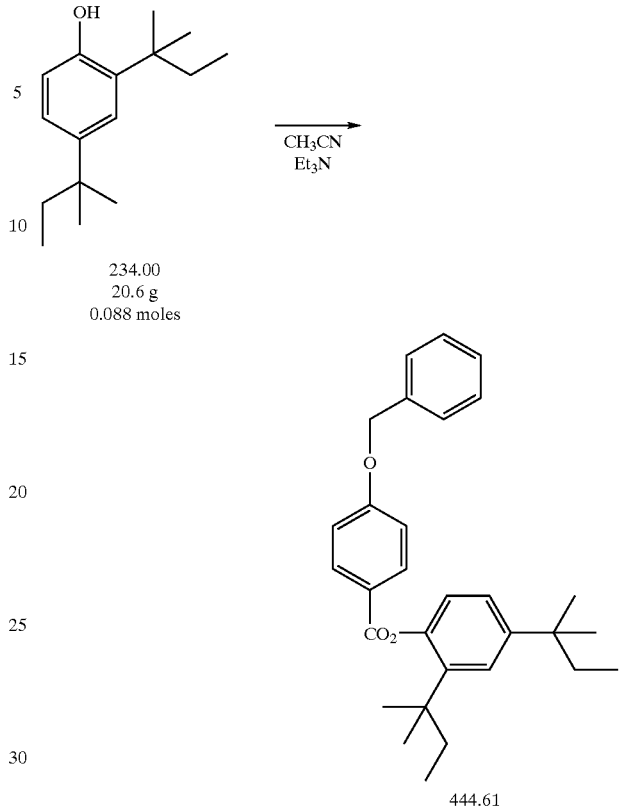

2,4-di-tert-pentyl phenol was dissolved in acetonitrile with triethyl amine present. The solid acid chloride was added to the mixture. The reaction was heated to reflux for 2 hours. TLC shows no starting material and two major products. Poured into a mixture of dilute HCl and EtOAc. Extracted into ethyl acetate, dried with magnesium sulfate and concentrated to an oil. This was dissolved in toluene and chromatographed with heptane/ethyl acetate 5%. Concentrated to an oil, slurried in P950 ligroin and cooled. The solid that formed was filtered and air dried to give 7.3 grams (35%) as a white solid.

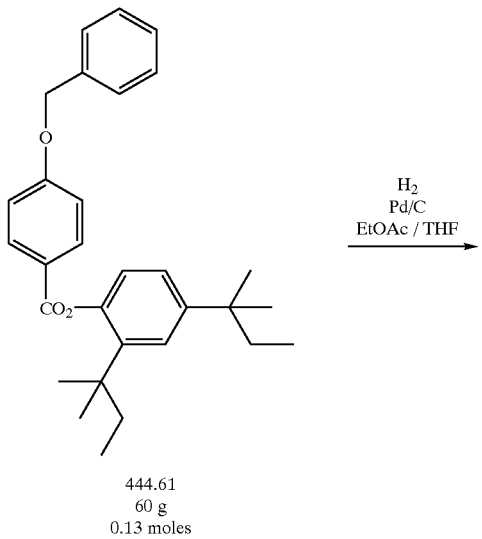

-continued

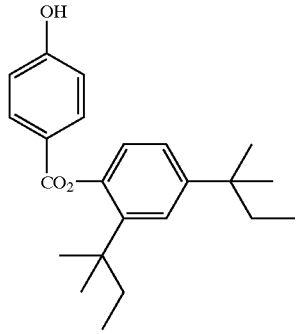

ACT20
354.49

The benzyl-blocked phenol was dissolved in a solution of ethyl acetate and THF. 10% Pd on Carbon was added and the reaction was shaken under hydrogen for 18 hours. The catalyst was removed by filtration through celite. The solvent was removed under vacuum on the roto evaporator. The solid that formed was slurried in P950 ligroin, filtered and air dried. This was recrystallized from heptane and dichloromethane (600/150). The solid that formed on cooling was filtered and air dried to give on spot on TLC, 37.5 grams (81%). The structure was confirmed by NMR and Mass Spec.

PHOTOGRAPHIC EXAMPLES

Comparative and inventive dispersions used for the photographic examples were prepared and coated with a high-boiling solvent, for example, dibutylsebacate (S1). Typical comparative dispersions were prepared by adding an oil phase containing a 1:1:3 weight ratio of coupler: dibutylsebacate:ethyl acetate to an aqueous phase containing gelatin and the dispersing agent ALKANOL XC (Dupont) in a 10:1 weight ratio. Each of the resulting mixtures was passed through a colloid mill to disperse the coupler-containing oil phase in the aqueous phase as small particles. Inventive dispersions were prepared by the same milling process. The typical resulting comparative dispersions contained 1.50% by weight of coupler (P), 1.50% by weight of dibutylsebacate (S1), 4.50% by weight ethyl acetate, 6.0% by weight of gelatin and 0.60% by weight of Alkanol XC. A typical inventive formula contained 0.90% coupler (P), 0.30% auxiliary phenolic coupler (AP) and 0.30% activator (ACT) while holding the other dispersion components constant. The detailed formulation approach was adopted primarily due to experimental convenience and should not be construed as limiting the practice of the invention.

Sufficient coupler dispersion was mixed with an undyed silver iodobromide emulsion and additional gelatin and coated on cellulose acetate butyrate support to yield laydowns shown in the respective Tables for each photographic example. For example, in comparative example 1.1 in Table III, this corresponded to 1.076 mmol/sq m of coupler (P1) (0.646 g/m$^2$). In inventive example 1.9, sufficient coupler dispersion to yield a laydown of 0.646 mmol/sq m of coupler (P1) (0.387 g/m$^2$) was used to demonstrate the ability to significantly reduce the laydown of the primary coupler of Formula [P]. The additional components of the inventive formulations are described in detail in the individual photographic examples. On coating, the ethyl acetate auxiliary solvent in the dispersions evaporates. The layer containing coupler and silver halide was overcoated with a layer containing gelatin and the hardener bis (vinylsulfonylmethyl)ether. The coating structure is shown in Table I with laydowns in g/sq m given in parentheses (except where noted).

TABLE I

| |
|---|
| Overcoat: |
| Gelatin (2.69) |
| Bis(vinylsulfonylmethyl)ether Hardener (0.129) |
| Emulsion Layer: |
| Gelatin (3.77) |
| Coupler dispersion formula (see Table III) |
| AgIBr (3.5% iodide) emulsion, 0.7 $\mu$m average grain size (0.646 as silver) |
| Support: cellulose acetate butyrate |

After hardening, samples of each of the films were exposed through a step tablet on a 1B sensitometer and processed using the KODAK FLEXICOLOR C-41 color negative procedure A, or modified procedure B, described in Table II. The developer in procedure B contains 4.0 g/l citrazinic acid (CZA) which competes with the in-film couplers (in comparative and inventive dispersions) for oxidized developer. The remaining processing steps were the same for each of procedures A and B. Measurements of status M red density vs. exposure were made for each processed film strip, and photographic contrast (gamma, $\gamma$) was determined from the slopes of such plots. In addition the maximum photographic density (DMAX_R) was determined in each case.

TABLE II (Photographic Process Description)

| Processing Step | Time (s) | Agitation gas |
|---|---|---|
| A) C-41 Developer | 120 | Nitrogen |
| Or | | |
| B) C-41 Developer with 4.0 g/l Citrazinic Acid (CZA) | 120 | Nitrogen |
| Acetic Acid Stop Bath | 30 | Nitrogen |
| Flexicolor III Bleach | 180 | Air |
| Wash | 180 | None |
| Fix | 240 | Nitrogen |
| Wash | 180 | None |
| Photoflow (wetting agent) | 30 | None |

Processing temperature 100° F. (37.8 C)

The activity of a coupler in film can be related to the resistance of its gamma in processing Procedure A ($\gamma_{C41}$) from being reduced in processing Procedure B ($\gamma_{CZA}$) One way to represent the photographic activity (PA) is by the formula:

$$PA=(\gamma_{CZA}/\gamma_{C41})\times 100.$$

The higher the PA number, the more active the coupler.

The lambda max of the photographically formed dye was evaluated at an exposure step close to a status M red density of 1.0. In order to correct for sensitizing dye and other DMIN stain phenomenon the spectrophotometric data was DMIN corrected in that the densities at DMIN were subtracted from the densities determined at the exposure step near the density of 1.0. The wavelengths of maximum density (lambda max in nm) are determined in this fashion are reported in the photographic examples.

Example 1

This example illustrates how the present invention allows up to a 40% decrease in the use of a primary phenolic coupler (P1) by using a minimum amount of an activating compound (ACT1) and in addition the use of an auxiliary phenolic coupler (AP1) while maintaining PA at least at 55, lambda max in the range of 688–697, and DMAX_R equal to or above 1.70.

TABLE III

| Ex | Type | Formula | P1* | AP1* | ACT1* | PA | Lambda Max | DMAX_R |
|---|---|---|---|---|---|---|---|---|
| 1.1 | Comp | 1:1<br>P1:S1 | 0.646 | — | — | 64 | 693 | 1.73 |
| 1.2 | Comp | 1:1<br>P1:S1 | 0.516 | — | — | 59 | 694 | 1.74 |
| 1.3 | Comp | 1:1<br>P1:ACT1 | 0.646 | — | 0.646 | 63 | 703 | 2.06 |
| 1.4 | Comp | 1:1<br>P1:ACT1 | 0.387 | — | 0.387 | 58 | 698 | 1.47 |
| 1.5 | Comp | 0.67:0.33:0.33<br>P1:ACT1:S1 | 0.387 | — | 0.194 | 55 | 695 | 1.41 |
| 1.6 | Comp | 1/2:1/2:1<br>P1:AP1:S1 | 0.387 | 0.387 | — | 51 | 683 | 2.41 |
| 1.7 | Inv | 0.33:0.33:0.33:0.33<br>P1:AP1:ACT1:S1 | 0.387 | 0.387 | 0.387 | 60 | 688 | 2.66 |
| 1.8 | Comp | 0.25:0.25:0.50<br>P1:AP1:ACT1 | 0.387 | 0.387 | 0.774 | 67 | 701 | 2.78 |
| 1.9 | Inv | 0.60:0.20:0.20:1.0<br>P1:AP1:ACT1:S1 | 0.387 | 0.129 | 0.129 | 56 | 690 | 1.85 |
| 1.10 | Comp | 1:1<br>AP1:S1 | — | 0.646 | — | 37 | 660 | 2.41 |
| 1.11 | Comp | 1:1<br>AP1:ACT1 | — | 0.646 | 0.646 | 59 | 674 | 3.17 |

*g/m$^2$

Examples 1.1 and 1.2 are formulations routinely used in the prior art, with P1 coated at two levels. In examples 1.10 and 1.11, AP1 by itself is clearly an unsuitable replacement for P1 for color negative applications due to the short lambda max values obtained; 660 nm in example 10 with S1 and 674 nm for Example 1.11 with ACT1 as the only solvent. The low activity (PA) of AP1 in S1 (example 1.10) is remedied by the use of ACT1 in example 1.11, however the lambda max of AP1 is unsuitable in both solvents. In examples 1.3 and 1.4 use of ACT1 as the sole solvent for P1 shifts the lambda max to excessively long values, 703 and 698 nm respectively in examples 1.3 and 1.4. In addition, if the amount of P1 is decreased in example 1.4 the maximum density is undesirably decreased. In example 1.5, the level of P1 has been decreased by 40% and ACT1 has been substituted for 50% of S1 (compare example 1.1). This results in a desirable lambda max of 695, but the maximum density is undesirably decreased. Example 1.6 with equal amounts of P1 and AP1 in S1 (and no ACT1) gives too short a lambda max (683 nm) and low PA. Example 1.8 substitutes ACT1 as the only solvent but has P1 and AP1 as the coupler (compare to Example 1.4). The effect of ACT1 on the lambda max of AP1 has been to shift it to longer wavelength (see Example 1.10 and 1.11), but the overall effect on the combination of P1 and AP1 has shifted the lambda max too bathochromically. The inventive Example 1.7, with equal amounts of P1, AP1, and ACT1 and low level of S1 exhibits improved lambda max and, excellent maximum density. The inventive formula in Example 1.9 enables a 40% decrease in the level of P1 while maintaining acceptable maximum density and dye lambda max while minimizing the use of AP and ACT.

Example 2

This example illustrates the advantageous use of various activators (ACT) when combined with auxiliary coupler AP1 in the formula of the invention.

TABLE IV

| Ex | Type | Formula | P1* | PA | Lambda Max | DMAX_R |
|---|---|---|---|---|---|---|
| 2.1 | Comp | 1:1<br>P1:S1 | 0.646 | 57 | 694 | 1.900 |
| 2.2 | Comp | 1:1<br>P1:S1 | 0.484 | 56 | 695 | 1.460 |
| 2.3 | Comp | 1:1.66<br>P1:S1 | 0.484 | 59 | 692 | 1.647 |
| 2.4 | Comp | 0.75:0.25:1.0<br>P1:ACT1:S1 | 0.484 | 59 | 693 | 1.702 |
| 2.5 | Inv | 0.60:0.20:0.20:1.0<br>P1:AP1:ACT1:S1 | 0.387 | 57 | 689 | 1.832 |
| 2.6 | Comp | 0.75:0.25:1.0<br>P1:ACT2:S1 | 0.484 | 62 | 694 | 1.699 |
| 2.7 | Inv | 0.60:0.20:0.20:1.0<br>P1:AP1:ACT2:S1 | 0.387 | 59 | 690 | 1.979 |
| 2.8 | Comp | 0.75:0.25:1.0<br>P1:ACT13:S1 | 0.484 | 65 | 692 | 1.819 |
| 2.9 | Inv | 0.60:0.20:0.20:1.0<br>P1:AP1:ACT13:S1 | 0.387 | 58 | 690 | 2.016 |
| 2.10 | Comp | 0.70:0.30:0.86<br>P1:ACT13:S1 | 0.484 | 64 | 695 | 1.796 |
| 2.11 | Inv | 0.57:0.19:0.24:0.89<br>P1:AP1:ACT13:S1 | 0.387 | 60 | 692 | 1.878 |
| 2.12 | Comp | 0.75:0.25:1.0<br>P1:ACT7:S1 | 0.484 | 55 | 694 | 1.652 |
| 2.13 | Inv | 0.60:0.20:0.20:1.0<br>P1:AP1:ACT7:S1 | 0.387 | 56 | 690 | 1.804 |
| 2.14 | Comp | 0.62:0.38:0.64<br>P1:ACT7:S1 | 0.484 | 53 | 694 | 1.478 |
| 2.15 | Inv | 0.51:0.17:0.32:0.70<br>P1:AP1:ACT7:S1 | 0.387 | 52 | 689 | 1.739 |

*g/m$^2$

Comparative examples 2.1 and 2.2 are examples of high and low levels of cyan coupler P1 as normally coated. Comparative example 2.3 demonstrates that additional solvent S1 although increasing DMAX_R at the lower level of P1 (versus Comp 2.2) still has a lower DMAX_R than is achieved by almost other any combination of P1 with ACT alone. All of the inventive combinations (which incorporate AP in addition to ACT) have higher DMAX_R, some substantially. In addition, all of the inventive formulations have higher DMAX_R than the corresponding comparative formulations (without AP) even though less P1 is coated. Compare examples 2.5 vs. 2.4, 2.7 vs. 2.6, etc. All of the lambda max's of the formula of the invention are in the desired range for color negative films.

Example 3

This example illustrates the advantageous use of additional activators (ACT) when combined with auxiliary coupler AP1 in the formula of the invention.

TABLE V

| Ex | Type | Formula | P1* | PA | Lambda Max | DMAX_R |
|---|---|---|---|---|---|---|
| 3.1 | Comp | 1:1 P1:S1 | 0.646 | 57 | 693 | 2.174 |
| 3.2 | Comp | 0.75:0.25:1.0 P1:ACT1:S1 | 0.484 | 52 | 692 | 1.786 |
| 3.3 | Inv | 0.60:0.20:0.20:1.0 P1:AP1:ACT1:S1 | 0.387 | 53 | 690 | 1.894 |
| 3.4 | Comp | 0.75:0.25:1.0 P1:ACT3:S1 | 0.484 | 47 | 694 | 1.637 |
| 3.5 | Inv | 0.60:0.20:0.20:1.0 P1:AP1:ACT3:S1 | 0.387 | 46 | 691 | 1.905 |
| 3.6 | Comp | 0.75:0.25:1.0 P1:ACT4:S1 | 0.484 | 54 | 694 | 1.665 |
| 3.7 | Inv | 0.60:0.20:0.20:1.0 P1:AP1:ACT4:S1 | 0.387 | 58 | 689 | 1.883 |
| 3.8 | Comp | 0.75:0.25:1.0 P1:ACT5:S1 | 0.484 | 63 | 694 | 1.667 |
| 3.9 | Inv | 0.60:0.20:0.20:1.0 P1:AP1:ACT5:S1 | 0.387 | 57 | 690 | 1.871 |
| 3.10 | Comp | 0.75:0.25:1.0 P1:ACT34:S1 | 0.484 | 64 | 694 | 1.612 |
| 3.11 | Inv | 0.60:0.20:0.20:1.0 P1:AP1:ACT34:S1 | 0.387 | 61 | 690 | 1.809 |
| 3.12 | Comp | 0.75:0.25:1.0 P1:ACT33:S1 | 0.484 | 66 | 694 | 1.573 |
| 3.13 | Inv | 0.60:0.20:0.20:1.0 P1:AP1:ACT33:S1 | 0.387 | 64 | 689 | 2.013 |
| 3.14 | Inv | 0.60:0.20:0.20:1.0 P1:AP1:ACT35:S1 | 0.387 | 59 | 690 | 1.900 |

*g/m$^2$

Comparative example 3.1 is an example of the high level of cyan coupler P1 as normally coated. All of the inventive formulations have higher DMAX_R than the corresponding comparative formulations (without AP) even though less P1 is coated in the inventive combination. Compare examples 3.3 vs. 3.2, 3.5 vs. 3.4, 3.7 vs. 3.6, 3.9 vs. 3.8. All of the lambda max's of the formula of the invention are in the desired range. This trend continues in examples 3.11 vs. 3.10, and 3.13 vs. 3.12, however, these activators are less preferred since their low log Kow greatly enhances their tendency to migrate between film layers and from the film into the environment. Example 3.14 is another example of a phenolic activator that yields good DMAX_R, however it also has a log Kow lower than the preferred 5.0.

Example 4

This example illustrates the advantageous use of additional activators (ACT) when combined with auxiliary coupler AP1 in the formula of the invention.

TABLE VI

| Ex | Type | Formula | P1* | PA | Lambda Max | DMAX R |
|---|---|---|---|---|---|---|
| 4.1 | Comp | 1:1 P1:S1 | 0.646 | 62 | 695 | 1.906 |

TABLE VI-continued

| Ex | Type | Formula | P1* | PA | Lambda Max | DMAX R |
|---|---|---|---|---|---|---|
| 4.2 | Comp | 0.75:0.25:1.0 P1:ACT1:S1 | 0.484 | 59 | 690 | 1.648 |
| 4.3 | Inv | 0.60:0.20:0.20:1.0 P1:AP1:ACT1:S1 | 0.387 | 57 | 688 | 1.900 |
| 4.4 | Comp | 0.75:0.25:1.0 P1:ACT3:S1 | 0.484 | 60 | 694 | 1.696 |
| 4.5 | Inv | 0.60:0.20:0.20:1.0 P1:AP1:ACT3:S1 | 0.387 | 55 | 688 | 1.860 |
| 4.6 | Comp | 0.75:0.25:1.0 P1:ACT8:S1 | 0.484 | 60 | 695 | 1.671 |
| 4.7 | Inv | 0.60:0.20:0.20:1.0 P1:AP1:ACT8:S1 | 0.387 | 54 | 690 | 1.826 |
| 4.8 | Comp | 0.75:0.25:1.0 P1:ACT9:S1 | 0.484 | 64 | 696 | 1.581 |
| 4.9 | Inv | 0.60:0.20:0.20:1.0 P1:AP1:ACT9:S1 | 0.387 | 61 | 691 | 1.953 |
| 4.10 | Comp | 0.75:0.25:I.0 P1:ACT10:S1 | 0.484 | 64 | 694 | 1.761 |
| 4.11 | Inv | 0.60:0.20:0.20:1.0 P1:AP1:ACT10:S1 | 0.387 | 61 | 691 | 1.915 |
| 4.12 | Comp | 0.75:0.25:1.0 P1:ACT12:S1 | 0.484 | 69 | 692 | 1.791 |
| 4.13 | Inv | 0.60:0.20:0.20:1.0 P1:AP1:ACT12:S1 | 0.387 | 63 | 691 | 1.882 |

*g/m$^2$

Comparative example 4.1 is an example of the high level of cyan coupler P1 as normally coated. All of the inventive formulations have higher DMAX_R than the corresponding comparative formulations (without AP) even though less P1 is coated in the inventive combination. Compare examples 4.3 vs. 4.2, 4.5 vs. 4.4, 4.7 vs. 4.6, 4.9 vs. 4.8, etc. All of the lambda max's of the formula of the invention are in the desired range.

Example 5

Practice of the Invention With Additional Couplers (P), Auxiliary Phenols (AP), and Solvents (S)

This example illustrates the advantages of inventive combinations by variation of P, AP, ACT and non-phenolic solvent S.

TABLE VII

| Ex | Type | Formula | P (g/m$^2$) | PA | Lamda Max | DMAX_R |
|---|---|---|---|---|---|---|
| 5.1 | Comp | 1:1 P:S1 | P1 (0.646) | 65 | 693 | 1.926 |
| 5.2 | Inv | 0.60:0.20:0.20:1.0 P:AP2:ACT1:S1 | P1 (0.387) | 63 | 688 | 1.959 |
| 5.3 | Inv | 0.60:0.20:0.20:1.0 P:AP2:ACT14:S1 | P1 (0.387) | 60 | 689 | 2.015 |
| 5.4 | Inv | 0.60:0.20:0.20:1.0 P:AP1:ACT1:S1 | P1 (0.387) | 59 | 689 | 1.948 |
| 5.5 | Inv | 0.60:0.20:0.20:1.0 P:AP1:ACT14:S1 | P1 (0.387) | 61 | 692 | 1.936 |
| 5.6 | Comp | 1:1 P:S2 | P1 (0.646) | 66 | 695 | 1.915 |
| 5.7 | Inv | 0.60:0.20:0.20:1.0 P:AP1:ACT1:S2 | P1 (0.387) | 60 | 692 | 1.900 |
| 5.8 | Inv | 0.60:0.20:0.20:1.0 P:AP1:ACT14:52 | P1 (0.387) | 60 | 690 | 1.919 |
| 5.9 | Comp | 1:1 P:S1 | P2 (0.821) | 44 | 696 | 3.100 |
| 5.10 | Comp | 0.75:0.25:1.0 P:ACT1:S1 | P2 (0.616) | 47 | 697 | 2.475 |

TABLE VII-continued

| Ex | Type | Formula | P (g/m$^2$) | PA | Lam-da Max | DMAX_R |
|---|---|---|---|---|---|---|
| 5.11 | Inv | 0.60:0.20:0.20:1.0 P:AP1:ACT1:S1 | P2 (0.493) | 49 | 697 | 2.738 |
| 5.12 | Comp | 1:1 P:S1 | P3 (0.690) | 58 | 697 | 2.801 |
| 5.13 | Comp | 0.75:0.25:1.0 P:ACT1:S1 | P3 (0.517) | 57 | 696 | 2.504 |
| 5.14 | Inv | 0.60:0.20:0.20:1.0 P:AP1:ACT1:S1 | P3 (0.414) | 55 | 694 | 2.444 |

In inventive examples 5.2, 5.3, 5.4, and 5.5, P is fixed at P1 and S is S1 while AP and ACT are varied. All of the examples yield high DMAX_R's even with a 40% reduction in P from comparative example 5.1. In inventive examples 5.7 and 5.8, P is fixed at P1, S has been changed to S2 (dibutyl phthalate), AP is AP1, and ACT is varied. All of the examples yield high DMAX_R's even with a 40% reduction in P from comparative example 5.6. Comparative example 5.9 is the high level of cyan coupler P2 as normally formulated. Inventive formulation 5.11 has higher DMAX_R than the corresponding comparative formulation 5.10 (without AP1) even though less P2 is coated in the inventive combination. Comparative example 5.12 is the high level of cyan coupler P3 as normally formulated. Inventive formulation 5.14 has nearly equal DMAX_R to the corresponding comparative formulation 5.13 (without AP1) even though less P3 is coated in the inventive combination. All of the lambda max's of the formula of the invention are in the desired range.

Example 6

Multilayer Film Structure Comprising Combinations of This Invention

The multilayer film structure utilized for this example is shown schematically in Table VIII. Structures of components not provided previously are given immediately following Table VIII. Component laydowns are provided in units of mg/sq m unless otherwise indicated. This composition may also be coated on a support, such as polyethylene naphthalate, containing a magnetic recording layer.

TABLE VIII

| MULTILAYER FILM STRUCTURE | mg/sq meter |
|---|---|
| Layer 1 | |
| Gray silver | 150 |
| Chem-2 | 16.1 |
| Dye-2 | 32 |
| Dye-3 | 2.7 |
| Dye-4 | 3.8 |
| Dye-5 | 75 |
| Chem-5 | 97 |
| Gelatin | 1991 |
| Layer 2 | |
| Slow cyan emulsion | 209 |
| Slow-slow cyan emulsion | 331 |
| Cyan Coupler P1 | Table XI or Table X |
| Coup-2 | 75 |
| Coup-3 | 12 |
| Coup-4 | 13 |
| Coup-6 | 21 |

TABLE VIII-continued

| MULTILAYER FILM STRUCTURE | mg/sq meter |
|---|---|
| Chem-1 | 7.4 |
| Gelatin | 1804 |
| Layer 3 | |
| Mid cyan emulsion | 555 |
| Cyan Coupler P1 | Table XI or Table X |
| Coup-3 | 72 |
| Coup-4 | 32 |
| Coup-6 | 17 |
| Coup-7 | 70 |
| Chem-1 | 8.9 |
| Gelatin | 1150 |
| Layer 4 | |
| Fast cyan emulsion | 525 |
| Fast-fast cyan emulsion | 250 |
| Cyan Coupler P1 | Table XI or Table X |
| Coup-2 | 32 |
| Coup-3 | 30 |
| Coup-4 | 45 |
| Coup-6 | 50 |
| Chem-1 | 14.1 |
| Gelatin | 977 |
| Layer 5 | |
| Coup-4 | 16.1 |
| Chem-2 | 25 |
| Gelatin | 539 |
| Layer 6 | |
| Slow-Slow magenta emul | 365 |
| Coup-8 | 180 |
| Coup-9 | 101 |
| Chem-1 | 4.7 |
| Gelatin | 1168 |
| Layer 7 | |
| Slow Slow magenta emul | 170 |
| Slow Magenta emulsion | 35 |
| Mid magenta emulsion | 545 |
| Coup-8 | 308 |
| Coup-9 | 73 |
| Coup-5 | 29.1 |
| Coup-10 | 7 |
| Chem-1 | 10.4 |
| Gelatin | 1751 |
| Layer 8 | |
| Fast magenta emulsion | 560 |
| Fast-fast magenta emul. | 440 |
| Coup-2 | 2.5 |
| Coup-8 | 85 |
| Coup-9 | 82 |
| Coup-10 | 16 |
| Coup-5 | 13 |
| Chem-1 | 6.8 |
| Gelatin | 1276 |
| Layer 9 | |
| Coup-11 | 16.1 |
| Chem-2 | 25 |
| Dye-1 | 22 |
| Gelatin | 538 |
| Layer 10 | |
| Mid yellow emulsion | 230 |
| Slow yellow emulsion | 325 |

TABLE VIII-continued

| MULTILAYER FILM STRUCTURE | |
|---|---|
| | mg/sq meter |
| Slow-slow yellow emul. | 160 |
| Coup-7 | 1060 |
| Coup-2 | 5 |
| Coup-12 | 54 |
| Coup-4 | 32 |
| Chem-1 | 8.2 |
| Chem-3 | 2.4 |
| Chem-4 | 0.05 |
| Chem-7 | 16.9 |
| Gelatin | 1803 |
| Layer 11 | |
| Fast yellow emulsion | 650 |
| Fast-fast yellow emul. | 260 |
| Lippman emulsion | 54 |
| Coup-7 | 255 |
| Coup-13 | 108 |
| Coup-12 | 92 |
| Coup-2 | 5.0 |
| Chem-1 | 13.2 |
| Gelatin | 950 |
| Layer 12 | |
| Dye-5 | 161 |
| Dye-6 | 105 |
| Gelatin | 690 |
| Layer 13 | |
| Gelatin | 867 |

The above contains sequestrants, antifoggants, surfactants, antistat, matte beads and lubricants as is known in the art. The film also contains a hardener at 1.8% of total gel.

P1

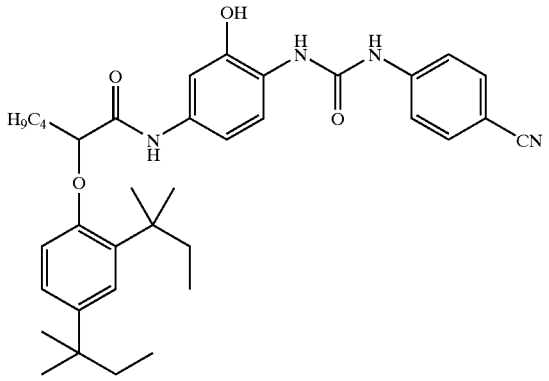

Coup-2

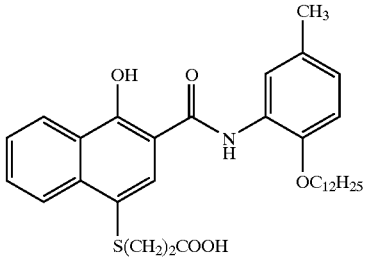

-continued

Coup-3

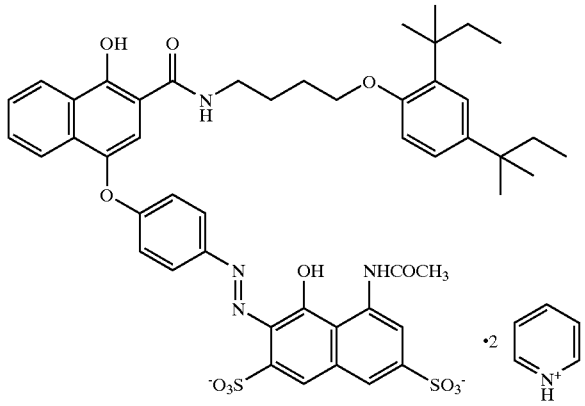

Coup-4

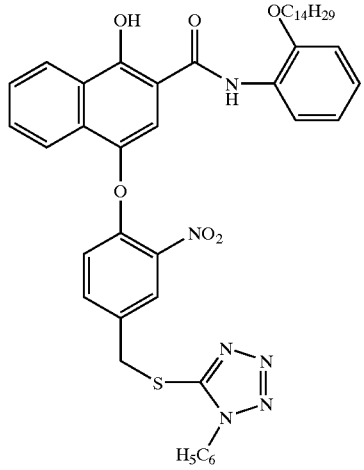

Coup -5

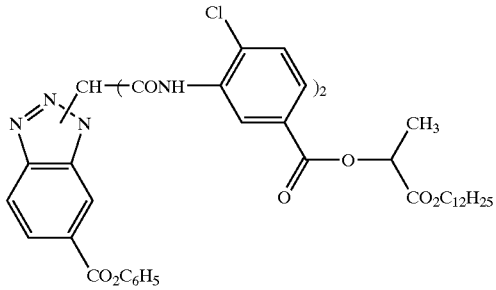

Coup-6

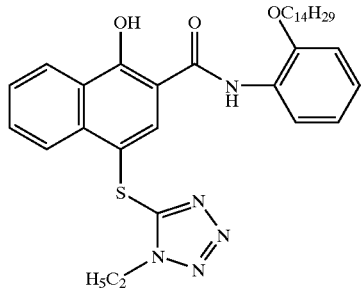

-continued
Coup-7
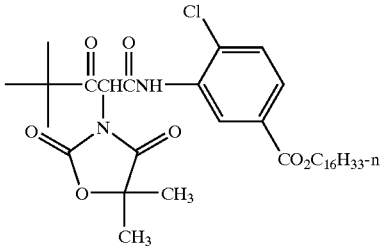
Coup-8
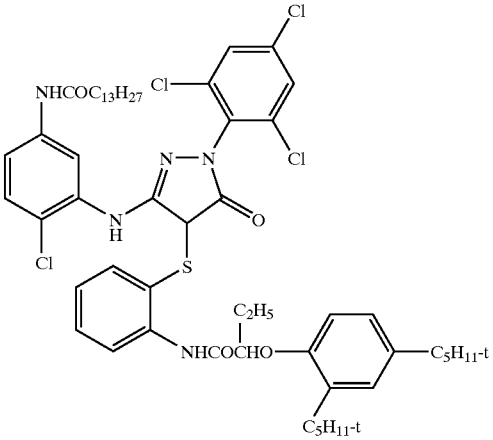
Coup-9
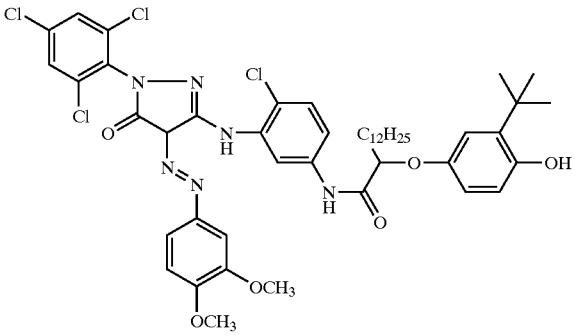
Coup-10
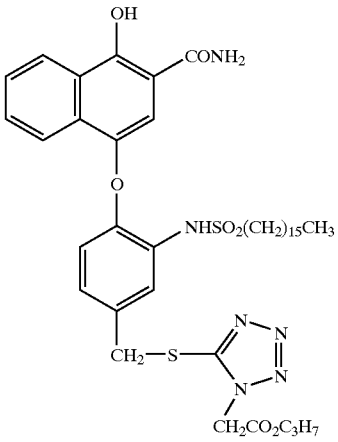
-continued
Coup-11
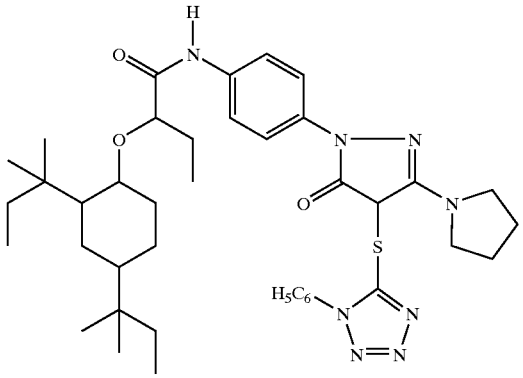
Coup-12
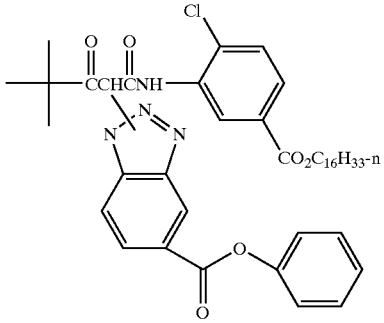
Coup-13
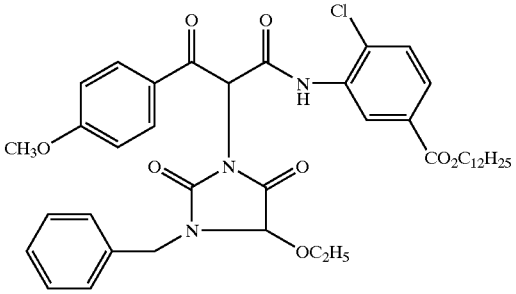
Chem-1 (1,2,4) Triazolo(1,5-a)pyrimidin-7-ol,5-methyl-sodium salt
Chem-2
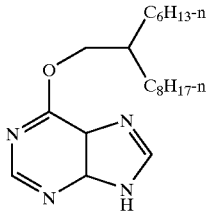
Chem-3 Cyclopenten-1-one,2,5-dihydroxy-5-methyl-3-(4-morpholinyl)-
Chem-4 -N-(3-(2,5-dihydro-5-thioxo-1H-tetrazol-1-yl) phenyl) L-alanine disodium salt Chem-5

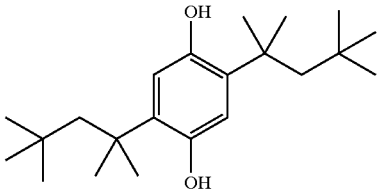

Chem-7 1-Propanesulfonic acid, 2-methyl-2-((1-oxo-2-propenyl)amino)monosodium salt, polymer with 2-propenamide Dye-1

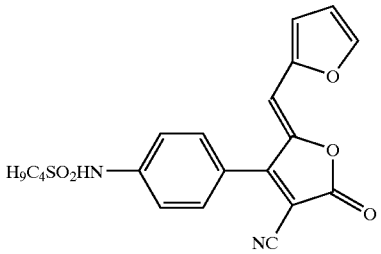

-continued

Dye-2

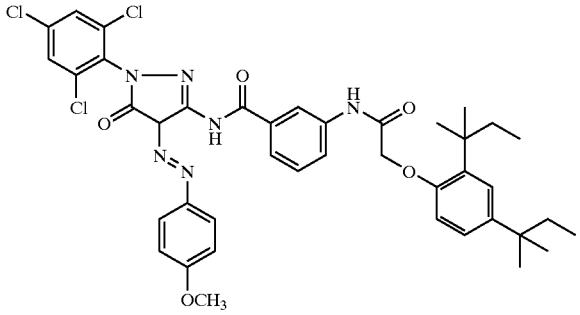

Dye-3 2,6-Anthracenedisulfonic acid, 9,10-dihydroxy-9,10-dioxo-4,8-bis(sulfomethyl)amino)-,tetrasodium salt Dye-4

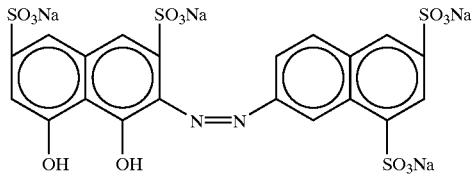

Dye-5

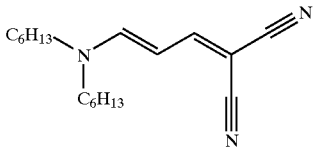

Dye-6

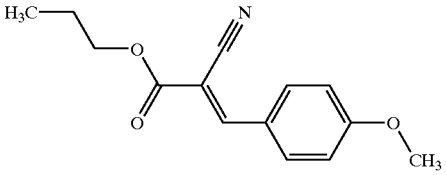

| Emulsion | Type | Diameter (μm) | Thickness (μm) | % bromide | Dye load (mm/m) | Sensitizing Dyes |
|---|---|---|---|---|---|---|
| SS cyan | Tab. | 0.43 | 0.11 | 99.5 | 0.66 | C-1 |
| S cyan | Tab. | 0.80 | 0.11 | 95.5 | 0.82 | C-1 |
| M cyan | Tab. | 1.24 | 0.12 | 96.3 | 1.00 | C-1 |
| F cyan | Tab. | 2.5 | 0.13 | 96.3 | 0.89 | C-1 |
| FF cyan | Tab. | 3.9 | 0.13 | 96.3 | 0.79 | C-2 |
| SS magenta | Tab. | 0.53 | 0.083 | 98.7 | 0.89 | M-1 |
| S magenta | Tab. | 0.47 | 0.12 | 97.0 | 1.04 | M-1 |
| M magenta | Tab. | 1.01 | 0.13 | 95.5 | 1.03 | M-1 |
| F magenta | Tab. | 1.86 | 0.13 | 95.5 | 0.95 | M-1 |
| FF magenta | Tab. | 2.9 | 0.13 | 96.3 | 0.85 | M-1 |
| SS yellow | Tab. | 0.53 | 0.083 | 98.7 | 1.1 | Y-1 |
| S yellow | Tab. | 0.99 | 0.14 | 98.6 | 0.90 | Y-1 |
| M yellow | Tab. | 1.26 | 0.14 | 95.8 | 0.80 | Y-1 |
| F yellow | Tab. | 2.67 | 0.13 | 95.8 | 0.80 | Y-1 |
| FF yellow | 3D | 1.22 | | 90.3 | 0.22 | Y-2 |

Sensitizing Dyes—

| | |
|---|---|
| C-1 = | SD1 + SD2 + SD3 |
| C-2 = | SD1 + SD2 + SD4 |
| M-1 = | SD5 + SD6 |
| Y-1 = | SD7 + SD8 |
| Y-2 = | SD9 |

SD1

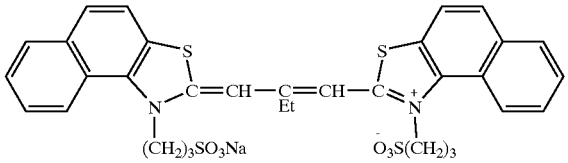

SD2

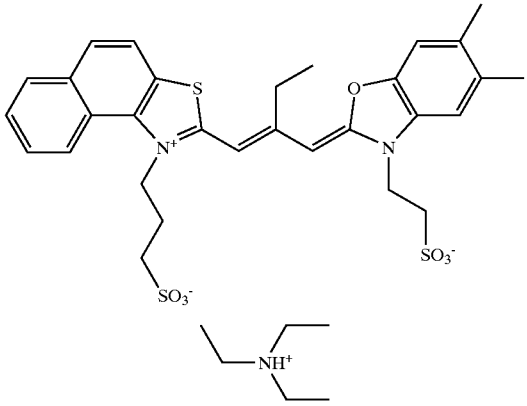

SD3

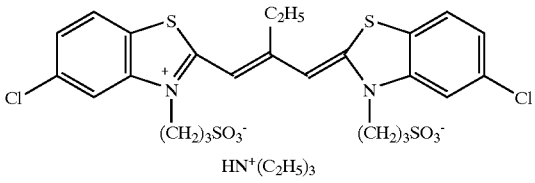

SD4

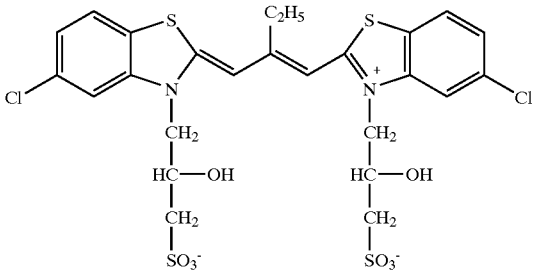

or or

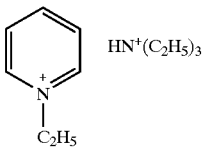

-continued

SD5

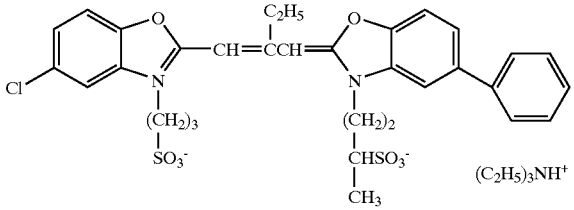

SD6

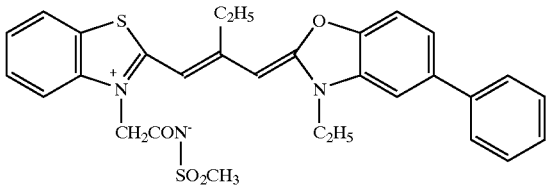

SD7

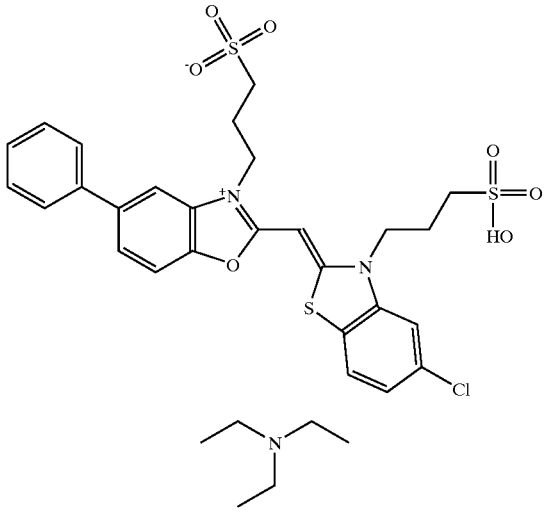

SD8

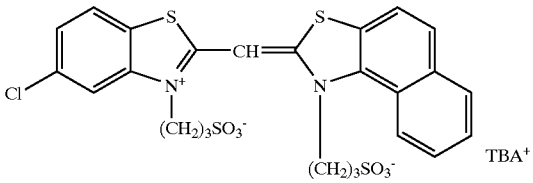

SD9

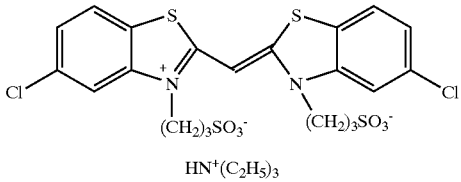

Coupler dispersions comprising cyan dye-forming coupler, phenolic activator, and non-phenolic solvent combinations of this invention and comparative combinations were coated in this multilayer film in layers 2, 3 and 4 at the levels of P1 indicated in Tables IX and Table X and then processed using KODAK FLEXICOLOR C-41 chemistry. The status M red density (red contrast) was then measured. The results are summarized in Table IX and Table X.

TABLE IX

| Ex. | Type | P1 Dispersion Formula* | P1** Total | P1** Layer 2 | P1** Layer 3 | P1** Layer 4 | Red Contrast |
|---|---|---|---|---|---|---|---|
| 6.1 | Comp | 1.0:1.0 P1:S1 | 1.045 | 0.645 | 0.330 | 0.070 | 0.57 |
| 6.2 | Comp | 0.75:0.25:1.0 P1:ACT14:S1 | 0.745 | 0.505 | 0.210 | 0.030 | 0.54 |
| 6.3 | Comp | 0.75:0.25:1.0 P1:ACT17:S1 | 0.745 | 0.505 | 0.210 | 0.030 | 0.54 |
| 6.4 | Inv | 0.6:0.2:0.2:1.0 P1:AP1:ACT14:S1 | 0.559 | 0.379 | 0.1575 | 0.0225 | 0.54 |
| 6.5 | Inv | 0.6:0.2:0.2:1.0 P1:AP1:ACT17:S1 | 0.559 | 0.379 | 0.1575 | 0.0225 | 0.53 |

*ratio by weight
**g/m$^2$

All of the multilayer films in Table IX have acceptable red contrast (within 0.04 of the comparative check). The results show that although formulations containing only P and ACT have acceptable red contrast, the inventive formulations allow lower usage of coupler P1 while retaining useful red contrast.

Example 7

Further Example of a Multilayer Film Structure Comprising Combinations of This Invention Additional multilayer films were prepared from other combinations of this invention and processed in a similar manner to Example 6. The results are shown in Table X.

TABLE X

| Ex | Type | P1 Dispersion Formula* | P1** Total | P1** Layer 2 | P1** Layer 3 | P1** Layer 4 | Red Contrast |
|---|---|---|---|---|---|---|---|
| 7.1 | Comp | 1.0:1.0 P1:S1 | 1.045 | 0.645 | 0.330 | 0.070 | 0.57 |
| 7.2 | Inv | 0.6:0.2:0.2:1.0 P1:AP1:ACT14:S1 | 0.655 | 0.379 | 0.226 | 0.050 | 0.57 |
| 7.3 | Inv | 0.6:0.2:0.2:1.0 P1:AP1:ACT18:S1 | 0.655 | 0.379 | 0.226 | 0.050 | 0.55 |
| 7.4 | Inv | 0.6:0.2:0.2:1.0 P1:AP1:ACT19:S1 | 0.655 | 0.379 | 0.226 | 0.050 | 0.55 |
| 7.5 | Inv | 0.6:0.2:0.2:1.0 P1:AP1:ACT1:S1 | 0.655 | 0.379 | 0.226 | 0.050 | 0.56 |
| 7.6 | Inv | 0.6:0.2:0.2:1.0 P1:AP1:ACT20:S1 | 0.655 | 0.379 | 0.226 | 0.050 | 0.57 |

*ratio by weight
**g/m$^2$

All of the multilayer films in Table X have acceptable red contrast (within 0.03 of the comparative example). The results show that that the inventive formulations have lower usage of the expensive coupler AP1 while retaining useful red contrast.

The preceding examples are set forth to illustrate specific embodiments of this invention and are not intended to limit the, scope of the compositions, materials or methods of the invention. Additional embodiments and advantages within the scope of the claimed invention will be apparent to one skilled in the art.

What is claimed is:

1. A color negative photographic element comprising a light sensitive silver halide emulsion imaging layer having associated therewith a cyan dye-forming coupler dispersion comprising a first phenolic cyan dye-forming coupler, a second phenolic cyan dye-forming coupler, a substantially non-color-developable phenolic activator compound, and a non-phenolic organic coupler solvent having a boiling point of at least 150C; wherein the first phenolic cyan dye-forming coupler is represented by the Formula [P]:

[P]

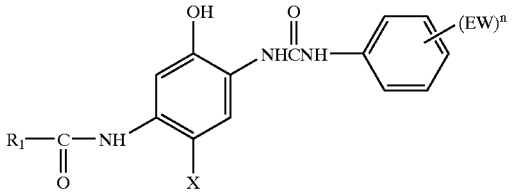

where $R_1$ represents a ballast group, n is from 0 to 3 and each EW represents independent electron withdrawing groups, and X represents a hydrogen atom or a coupling off group;

the second phenolic cyan dye-forming coupler is represented by [AP] and comprises at least one of Formula [AP-I] or Formula [AP-II]:

[AP-I]

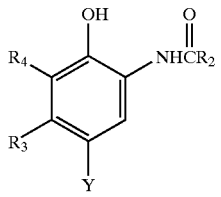

where $R_2$ represents a ballast group, $R_3$ represents an alkyl group, $R_4$ represents a hydrogen or halogen atom or an alkyl or an acylamino group, and Y represents a hydrogen atom or a coupling off group;

[AP-II]

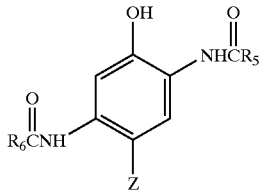

where $R_5$ and $R_6$ each independently represents an aliphatic group, an aryl group or a heterocyclic group, at least one of which is a ballast group, and Z represents a hydrogen atom or a coupling off group;

the substantially non-color-developable phenolic activator compound is represented by the Formula [ACT]:

[ACT]

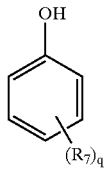

where q is from 1 to 3, and each $R_7$ independently represents an aliphatic group, a cycloalkyl group, an alkoxycarbonyl group, an aryloxycarbonyl group, an alkylcarbonyl group, an arylcarbonyl group, an acyloxy group, a sulfamoyl group, a sulfonamido group, a sulfonyl group, an aryl group, an alkoxy group, or a halogen atom; and wherein compounds represented by [P], [AP], and [ACT] are present in the coupler dispersion in relative weight fractions of from 0.30 to 0.65 for [P], from 0.15 to 0.35 for [AP], and from 0.15 to 0.35 for [ACT], provided the sum of the relative weight fractions for [P]+[AP]+[ACT]=1, and the weight ratio of the non-phenolic coupler solvent in the coupler dispersion is from 0.30 to 2.0 relative to the sum of [P]+[AP]+[ACT].

2. An element according to claim 1, wherein n=at least 1 and EW represents a cyano, chloro, fluoro, bromo, iodo, alkyl- or aryl-carbonyl, alkyl- or aryloxycarbonyl, acyloxy, carbonamido, alkyl- or aryl-carbonamido, alkyl- or aryloxycarbonylamino, alkyl- or aryl-sulfonyl, alkyl- or aryl-sulfonyloxy, alkyl- or aryl-oxysulfonyl, alkyl- or aryl-sulfoxide, alkyl- or aryl-sulfamoyl, alkyl- or arylsulfamoylamino, alkyl- or aryl-sulfonamido, aryl, alkyl, alkoxy, aryloxy, nitro, alkyl- or aryl-ureido or alkyl- or aryl-carbamoyl group.

3. An element according to claim 2, wherein at least one EW represents a halogen, cyano, alkoxycarbonyl, alkylsulfamoyl, alkylsulfonamido, alkylsulfonyl, carbamoyl, alkylcarbamoyl or alkylcarbonamido group.

4. An element according to claim 2, wherein at least one EW represents a cyano group.

5. An element according to claim 1, wherein $R_1$ represents a substituted or unsubstituted alkyl, aryl, or heterocyclic groups containing 8 to 42 carbon atoms.

6. An element according to claim 5, wherein $R_1$ represents —CHR'—O-Aryl, where R' represents an alkyl group and Aryl represents a substituted or unsubstituted aryl substituent.

7. An element according to claim 6, wherein R' represents an alkyl group of from 1 to 12 carbon atoms and Aryl represents a phenyl group substituted with at least one alkyl, hydroxy, or alkylsulfonamido group.

8. An element according to claim 7, wherein Aryl represents a phenyl group substituted with at least one branched alkyl group.

9. An element according to claim 1, wherein the second cyan dye-forming coupler is represented by Formula [AP-I].

10. An element according to claim 9, wherein where $R_2$ represents a substituted or unsubstituted alkyl, aryl, or heterocyclic groups containing 8 to 42 carbon atoms; $R_3$ represents an alkyl group of from 2 to 15 carbon atoms; and $R_4$ represents a hydrogen or chloro atom or an alkyl or an acylamino group of from 1 to 15 carbon atoms.

11. An element according to claim 1, wherein the second cyan dye-forming coupler is represented by Formula [AP-II].

12. An element according to claim 11, wherein $R_5$ and $R_6$ each represents a substituted or unsubstituted aliphatic group having from 1 to 32 carbon atoms, a phenyl or naphthyl group, or a 2-pyridyl, 2-imidazolyl, 2-furyl, or 6-quinolyl heterocyclic group.

13. An element according to claim 1, wherein the phenolic activator compound has a logarithmic octanol-water partition coefficient (log P) of at least 5.0.

14. An element according to claim 13, wherein the phenolic activator compound has a logP of at least 6.0.

15. An element according to claim 13, wherein substituents $R_7$ have at least 7 carbon atoms in total.

16. An element according to claim 15, wherein substituents $R_7$ have from 7 to 40 carbon atoms in total.

17. An element according to claim 16, wherein substituents $R_7$ have from 7 to 32 carbon atoms in total.

18. An element according to claim 16, wherein at least one $R_7$ substituent group is in the fourth position of the phenol ring (para position).

19. An element according to claim 18, wherein the para $R_7$ substituent comprises a straight- or branch-chained alkyl radical having one to 20 carbon atoms; an alkylcarbonyl or aryloxycarbonyl radical; or a sulfamoyl radical.

20. An element according to claim 1, wherein the non-phenolic coupler solvent comprises a phthalic acid alkyl ester, a phosphoric acid ester, a citric acid ester, a benzoic acid ester, an aliphatic amide, a mono or polyvalent alcohol, or an aliphatic dioic acid alkyl ester.

21. An element according to claim 20, wherein the non-phenolic coupler solvent comprises diundecyl phthalate, dibutyl phthalate, bis-2-ethylhexyl phthalate, dioctyl phthalate, tricresyl phosphate, diphenyl phosphate, tris- 2-ethylhexyl phosphate, tris-3,5,5-trimethylhexyl phosphate, tributylcitrate, tributyl acetylcitrate, 2-(2-butoxyethoxy)ethyl acetate, 1,4-cyclohexyldimethylene bis (2-ethylhexanoate), octyl benzoate, N,N-diethyl lauramide, N,N-diethyldodecanamide, N,N-dibutyldodecanamnide, oleyl alcohol, glycerin monooleate, or a diester of the formula R—$(CH_2)_m$—R' wherein R and R' each represent an alkoxycarbonyl group containing not more than 8 carbon atoms and m is an integer of from 1 to 10.

22. An element according to claim 20, wherein the non-phenolic coupler solvent comprises a phthalic acid alkyl ester or an aliphatic dioic acid alkyl ester.

23. An element according to claim 22, wherein the non-phenolic coupler solvent comprises diundecyl phthalate, dibutyl phthalate, bis-2-ethylhexyl phthalate, dioctyl phthalate, or a diester of the formula R—$(CH_2)_m$—R' wherein R and R' each represent an alkoxycarbonyl group containing not more than 8 carbon atoms and m is an integer of from 1 to 10.

24. An element according to claim 23, wherein the non-phenolic coupler solvent comprises dibutyl sebacate.

25. An element according to claim 1, wherein compounds represented by [P], [AP], and [ACT] are present in the coupler dispersion in relative weight fractions of from 0.50 to 0.60 for [P], from 0.15 to 0.35 for [AP], and from 0.15 to 0.35 for [ACT].

27. An element according to claim 1, wherein the weight ratio of the non-phenolic coupler solvent in the coupler dispersion is from 0.5 to 1.0 relative to the sum of [P]+[AP]+[ACT].

28. An element according to claim 1, wherein the compound represented by Formula [P] is compound P1:

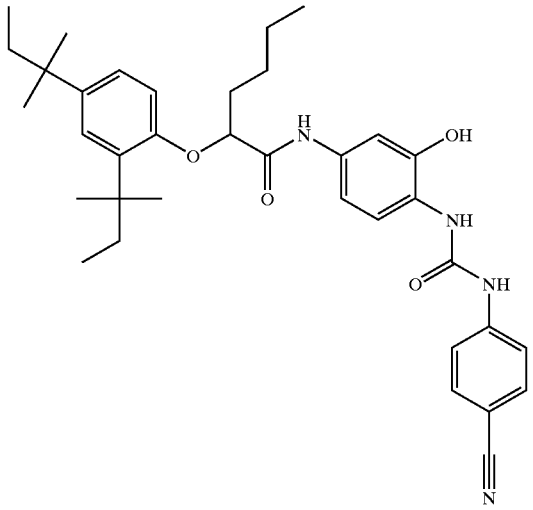

;

the compound represented by [AP] is of Formula [AP-I];

the compound represented by Formula [ACT] is compound ACT1, ACT14, or ACT17:

ACT1

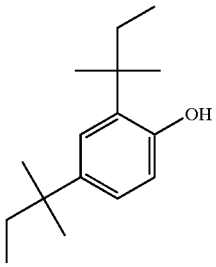

ACT14

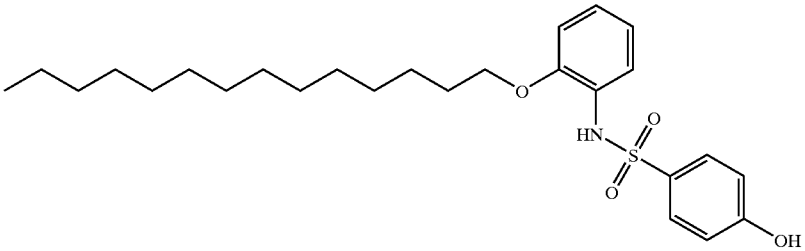

ACT17

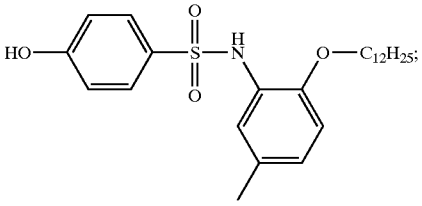

; and

26. An element according to claim 1, wherein compounds represented by [P], [AP], and [ACT] are present in the coupler dispersion in relative weight fractions of from 0.50 to 0.60 for [P], from 0.20 to 0.25 for [AP], and from 0.20 to 0.25 for [ACT].

the non-phenolic coupler solvent comprises a diester of the formula R—$(CH_2)_m$—R' wherein R and R' each represent an alkoxycarbonyl group containing not more than 8 carbon atoms and m is an integer of from 1 to 10.

29. An element according to claim 28, wherein the coupler represented by [AP] is of formula AP1:
AP1
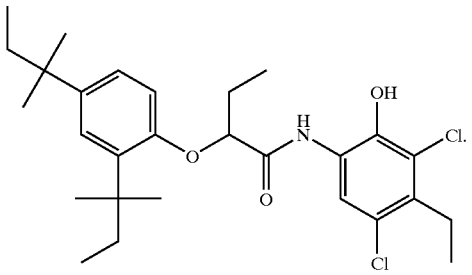
30. An element according to claim 29, wherein the non-phenolic coupler solvent comprises dibutyl sebacate.
* * * * *